US006447180B2

(12) United States Patent
Kamo

(10) Patent No.: US 6,447,180 B2
(45) Date of Patent: Sep. 10, 2002

(54) SOLUTION SUPPLYING DEVICE

(75) Inventor: Hisao Kamo, Matsudo (JP)

(73) Assignee: Chugai Photo Chemical Co. Ltd., Tokyo (JP)

( * ) Notice: Subject to any disclaimer, the term of this patent is extended or adjusted under 35 U.S.C. 154(b) by 0 days.

(21) Appl. No.: 09/863,231

(22) Filed: May 23, 2001

(30) Foreign Application Priority Data

May 25, 2000 (JP) ..... 2000-155286
Oct. 2, 2000 (JP) ..... 2000-302772

(51) Int. Cl.[7] ..... G03D 3/02
(52) U.S. Cl. ..... 396/626
(58) Field of Search ..... 396/604, 627, 396/626, 578; 118/52; 355/27–29

(56) References Cited

U.S. PATENT DOCUMENTS

| | | | |
|---|---|---|---|
| 4,044,366 A | 8/1977 | Goto | 396/40 |
| 5,184,164 A | 2/1993 | Kose et al. | 396/626 |
| 5,307,107 A | 4/1994 | Nozawa et al. | 396/626 |
| 5,488,477 A | 1/1996 | Patton et al. | 354/298 |

FOREIGN PATENT DOCUMENTS

| | | | |
|---|---|---|---|
| EP | 0714047 A2 | | 5/1996 |
| EP | 0741326 A1 | | 11/1996 |
| EP | 1069474 A1 | | 1/1999 |
| EP | 1087259 A1 | | 3/2001 |
| JP | 10-57944 | * | 3/1998 |
| JP | 2001-25655 | | 1/2001 |

* cited by examiner

*Primary Examiner*—D. Rutledge
(74) *Attorney, Agent, or Firm*—Knoble & Yoshida, LLC

(57) ABSTRACT

A solution supplying device is disclosed, that comprises a gas-solution separation tank for stocking an undiluted process solution supplied from a package that packs the undiluted process solution, a solution supplying pump for supplying the undiluted process solution stocked in the gas-solution separation tank to a processing tank, and an overpressure release valve for varying the inner pressure of the gas-solution separation tank. With the overpressure release valve, the solution supplying device can use a small solution supplying pump. Thus, a device such as an automatic developing device that performs a solution process can be compactly structured.

12 Claims, 20 Drawing Sheets

SOLUTION SUPPLYING DEVICE

BACKGROUND OF THE INVENTION

1. Field of the Invention

The present invention relates to a solution supplying device, for example, to a solution supplying device for supplying a process solution for a photographic material such as silver halide used in an automatic developing device.

2. Description of the Related Art

After a photographic material such as silver halide is exposed, a developing process is performed using process solutions such as a developing solution, a bleaching solution, and a fixing solution. Generally, in the developing process, an automatic developing device is used. When necessary, to keep each process solution active and the composition thereof constant, those process solutions are replenished. Each process solution is supplied as a concentrated solution comprised of a plurality of part solutions. Thus, when each process solution is used, it should be diluted and compensated with water for a predetermined concentration. However, since each process solution should be accurately diluted, a very laborious work is required so as to prevent the process solution from being improperly dissolved and contaminated with another process solution. In addition, when each process solution is compensated, it tends to splash, thereby dirty the human body, cloths, and peripheral devices.

To solve such problem, many prior art references have been proposed. For example, according to one prior art reference, a sucking nozzle is connected to a supplying vessel that packs a process solution so that an undiluted process solution is supplied to a process tank of an automatic developing device. In addition, a predetermined amount of water is supplied from a different diluting water stock tank to the process tank. As a result, the process solution is replenished without need to compensate it.

In particular, according to a prior art reference disclosed as Japanese Patent Laid open Publication No. 2000-2995, a flexible vessel is used. When the amount of an undiluted process solution decreases in the flexible vessel, the undiluted process solution can be prevented from contacting air. In addition, a solution empty state detecting device is disposed. The solution empty state detecting device detects the expansion of a gas that flows from the vessel to a solution supplying pump so as to determine that the solution contained in the vessel has run out. That replenishing method has excellent features of which an undiluted process solution is stable and the vessel can be easily replaced with a new one.

However, in the method according to the above-described related art reference, when an amount of air that exceeds the predetermined value enters a flow path, the solution empty state detecting device will malfunction. Thus, when an undiluted process solution is enclosed in a vessel as a product, the amount of air that enters the vessel should be strictly controlled. In addition, even if the amount of air that enters the vessel is strictly controlled, when a solution that is packed in the vessel for a long time produces a gas, since the amount of the gas that enters the flow path may exceed a predetermined value, such a method cannot be used.

In addition, as there are many types of output services due to an explosive increase of demands of silver salt prints of digital mediums, non-photograph shops tend to start DPE (Developing, Printing, and Enlarging) services. Thus, there are strong demands for an automatic developing device that does not need a large installation space, that does not need an experienced operator, and that does not need a full-time intervention of an operator.

In the replenishing device according to the related art reference, although the device can be operated easily, the structures of the solution supplying portion and the solution empty state detecting portion are complicated. Thus, it is difficult to reduce the sizes of those portions. Consequently, the replenishing device according to the related art reference is disadvantageous for a small automatic developing device. In addition, the size of the replenishing device according to the related art reference need to become large in proportion to the volume of a vessel connected thereto. Thus, the replenishing device according to the related art reference does not satisfy the needs for providing a vessel having a large volume that reduces the frequency of which the vessel is replaced. In addition, when the solution contained in the vessel has run out, unless it is replaced with a new one, the developing process cannot be continued. Thus, the automatic developing device always requires the intervention of an operator.

SUMMARY OF THE INVENTION

An object of the present invention is to provide an improved solution supplying device that allows an undiluted process solution to be stable, a vessel that packs the solution to be easily replaced, and a large amount of gas that enters a flow path to be prevented from malfunctioning. Another object of the present invention is to provide a solution supplying device that satisfies both needs for reducing the size of a solution supplying portion and the labor of the operator.

To accomplish such objects, an aspect of the present invention is a device for temporarily stocking a solution supplied from a vessel that packs the solution and supplying the solution to a destination, comprising a stock tank for stocking the solution supplied from the vessel, a solution supplying pump for supplying the solution stocked in the stock tank to the destination, and a pressure varying portion for varying the inner pressure of the stock tank.

According to the aspect of the present invention, when a pressure varying portion is disposed, since a small solution supplying pump can be used without a problem for supplying a solution, a device such as an automatic developing device can be compactly structured. When the solution is supplied from a vessel to a destination through a stock tank by the solution supplying pump, if the solution packed in the vessel has run out, an excessively reduced pressure state takes place in the stock tank. At a particular point, the sucking force of the solution supplying pump is balanced with the inner pressure of the stock tank, leading to a state that the solution stocked in the stock tank can no longer be sucked. However, according to the present invention, since the pressure varying portion is operated before such a suction disable state takes place, the excessively reduced pressure state can dissolve in the stock tank. Thus, the solution can be supplied continuously from the stock tank to the destination by the solution supplying pump. In other words, with the pressure varying portion, even if the power of the solution supplying pump is not large, the solution can be continuously supplied without an abnormality of the operation of the solution supplying pump.

The pressure varying portion is a valve disposed on the stock tank and opened so that outside air enters the stock tank when the inner pressure of the stock tank is a predetermined value or less. Thus, as the pressure varying portion, a valve can be used so that it opens and outside air enters the stock tank when the inner pressure of the stock tank is a predetermined value or less. In such a structure, when the valve is opened, the excessively reduced pressure state can dissolve in the stock tank. Alternatively, an orifice may be used instead of the valve. Thus, when the orifice is used, the excessively reduced pressure state can dissolve in the stock tank, by using a very simple structure and at very low cost.

The pressure varying portion is a volume varying chamber, disposed at a part of the stock tank, for varying the inner volume so as to vary the inner pressure. Thus, as a pressure varying portion, a volume varying chamber can be disposed. The volume varying chamber is structured in such a manner that the inner volume is large in the normal state, whereas the inner volume is small in the excessively reduced pressure state. Thus, when the inner volume of the volume varying chamber decreases, the excessively reduced pressure state can dissolve in the stock tank.

The inner volume of the volume varying chamber is decreased when the inner pressure of the stock tank is a predetermined value or less. In such a structure, when the inner volume of the volume varying chamber is decreased, the excessively reduced pressure state can dissolve in the stock tank.

The device further comprises a gas exhausting mechanism for exhausting a gas from a flow path for the solution, the flow path being formed from the vessel to the solution supplying pump. In such a structure, even if an unexpected amount of air enters a flow path, the solution empty state detecting device does not malfunction. Thus, when a solution is packed to a vessel as a product, it is not necessary to strictly control the amount of air that enters the vessel. In addition, even if a solution that has been stocked for a long time produces a gas, the solution can be used. In other words, when a gas is sucked to the flow path, the gas quickly separates from the solution in the stock tank. The gas gathers at an upper portion of the stock tank. When the amount of the gas exceeds a predetermined value, a gas exhausting mechanism exhausts the gas to the outside. Thus, even if an unexpected amount of gas enters the flow path, the gas can be exhausted to the outside thereof.

The gas exhausting mechanism has an exhausting pipe connected to the stock tank, an air pump, connected to the exhausting pipe, for exhausting a gas from the stock tank through the exhausting pipe, and a flow rate adjusting mechanism for adjusting the flow rate of the gas exhausted by the air pump. As a gas exhausting mechanism, an exhausting pipe and an air pump can be used.

The flow rate adjusting mechanism is composed of a plurality of pipes that have different diameters and that are connected. In such a structure, when a pipe has portions that are different in thickness and length, the flow rate of an exhaust gas can be adjusted to a predetermined value. When a pump having a larger flow rate than a desired exhaust flow rate is used, since the exhaust flow rate is too large, the solution may reversely flow in the air pump. However, when the pipe is partly narrowed, since a flow rate loss actively takes place, the exhaust flow rate of the gas can be adjusted.

A sensor for detecting a predetermined solution level of the solution is disposed in the stock tank. The operation of the air pump is controlled corresponding to a detected result of the sensor. In such a structure, an air pump is interlocked with a sensor that detects a solution level. With a time relay or the like, the air pump is stopped after a predetermined time period elapses. Thus, a gas in the stock tank can be exhausted effectively. In addition, since only one sensor for controlling the air pump is used, a device such as an automatic developing device can be structured compactly.

The sensor has a first sensor, disposed in the stock tank, for detecting a predetermined solution level of the solution, and a second sensor, disposed at a higher position than the first sensor in the stock tank, for detecting a predetermined solution level of the solution. The air pump is started corresponding to a detected result of the first sensor and is stopped corresponding to a detected result of the second sensor. Thus, with two sensors, a gas that enters the stock tank can be more accurately exhausted. When only one sensor is used, it tends to chatter. Thus, the service lives of the sensors can be prolonged.

A solution empty state detecting sensor is further disposed in the stock tank. In such a structure, a sensor detects a solution empty state in a vessel while a stock tank stores the solution. Thus, even if the solution of the vessel has run out, the process can be performed with the solution stocked in the stock tank. Consequently, unlike the conventional device, it is not necessary to replace the vessel just after the solution of the vessel has run out providing extra time before the replacing. Thus, since the operator does not need to always supervise the solution supplying device because of the extra time allowed in changing the vessel, the labor of the operator for the intervention of the automatic developing device can be reduced.

A solution empty state detecting sensor for detecting that the solution stocked in the stock tank runs out is further disposed. In such a structure, a solution empty state detecting sensor is disposed in the stock tank so that the sensor detects the solution empty state of the solution in the stock tank before the solution of the stock tank has run out. Thus, corresponding to the detected result of the sensor, the solution supplying pump and the solution supplying device can be stopped. Thus, when the solution has run out in both the stock tank and the vessel, the solution supplying pump is not operated. Consequently, air does not enter the solution supplying pump. As a result, the solution can be accurately supplied.

These and other objects, features and advantages of the present invention will become more apparent in light of the following detailed description of a best mode embodiment thereof, as illustrated in the accompanying drawings.

DESCRIPTION OF PREFERRED EMBODIMENTS

Next, with reference to the accompanying drawings, embodiments of the present invention will be described.

The present invention is applied for a solution supplying device for a photograph processing chemical or the like used in an automatic developing device.

(First Embodiment)

Figure 1:
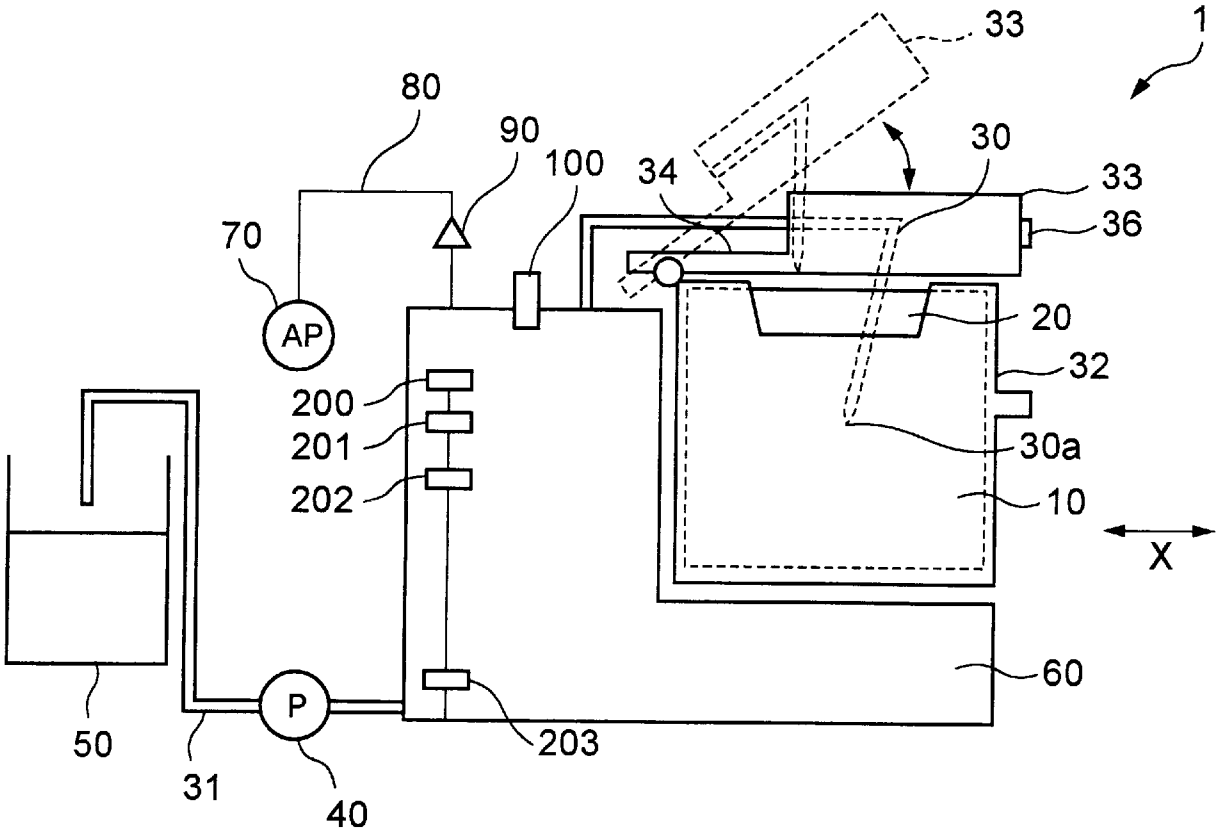
FIG. 1 is a schematic diagram showing the structure of a solution supplying device according to a first embodiment of the present invention.
Figure 2:
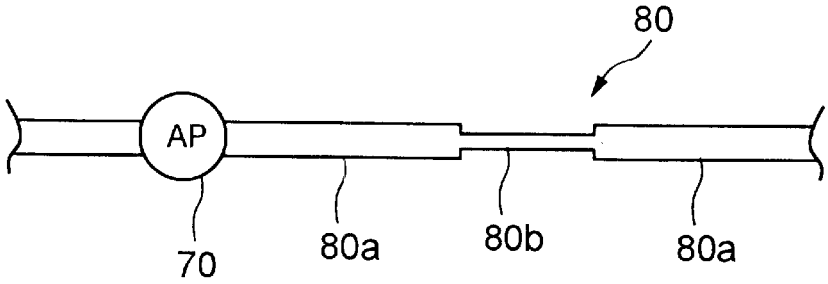
FIG. 2 is a schematic diagram showing the structure of an air exhaust tube.
Figure 3A:
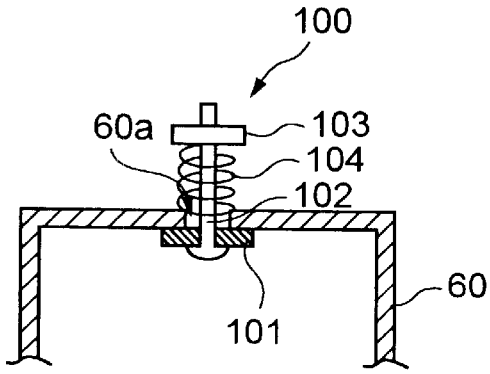
FIGS. 3A and 3B are schematic diagrams for explaining the operation of an overpressure release valve.
Figure 3B:
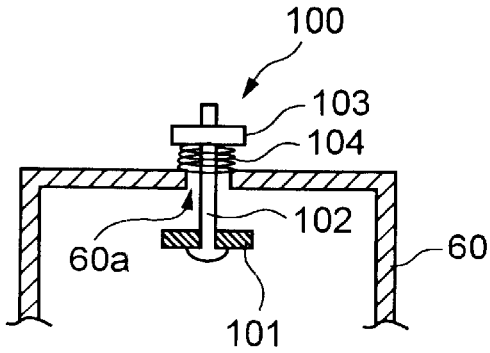
Figure 4:
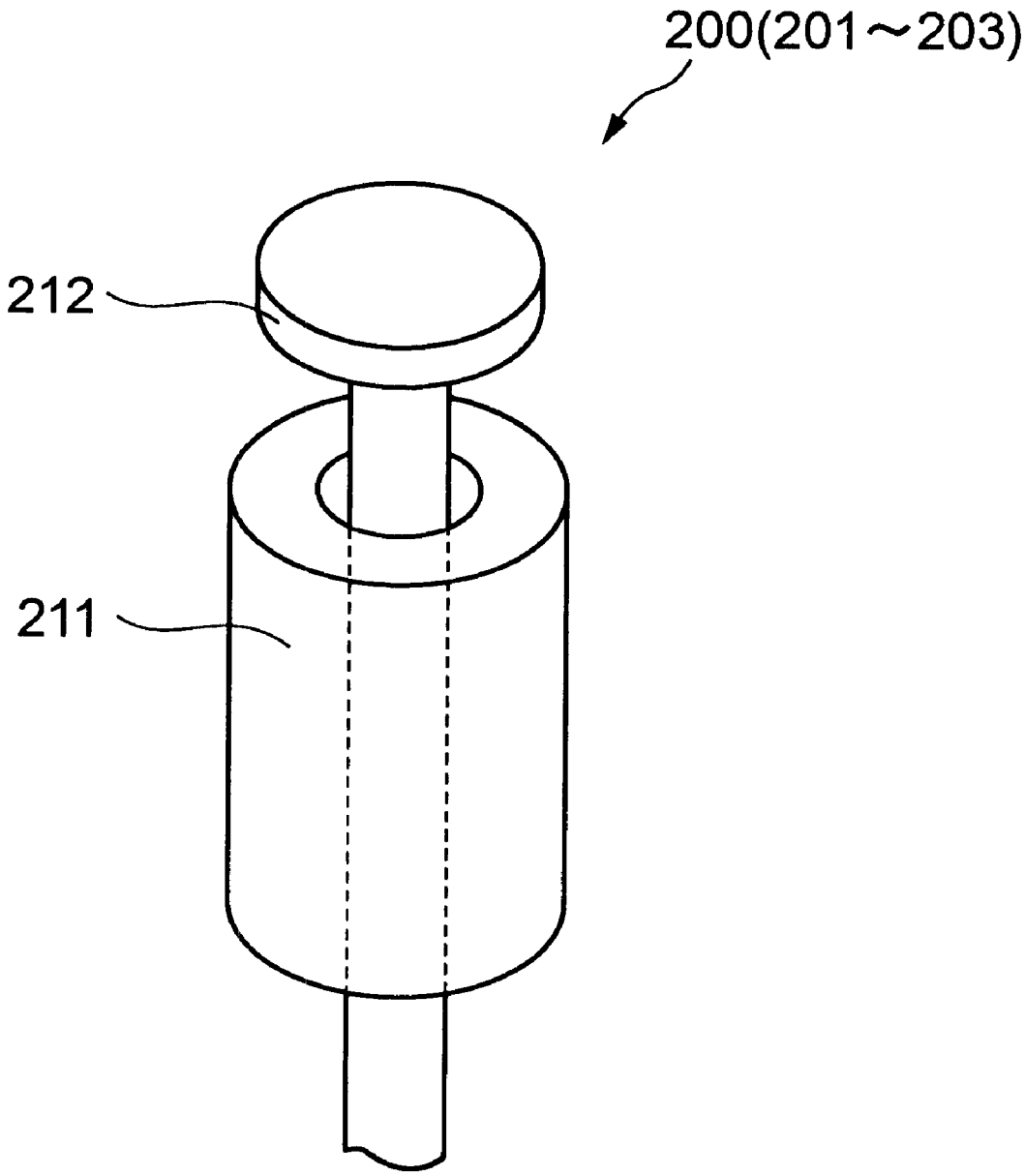
FIG. 4 is a perspective view showing the structure of a sensor.

Next, with reference to the accompanying drawings, a first embodiment of the present invention will be described. FIG. 1 is a sectional view showing an outlined structure of a solution supplying device. FIG. 2 is a schematic diagram showing an outlined structure of an air exhaust tube. FIGS. 3A and 3B are schematic diagrams for explaining the operation of an overpressure release valve. FIG. 4 is a perspective view showing the structure of a sensor. When the solution supplying device according to the present invention is used as a replenishing device for a silver halide, which is a photographic material, used in an automatic developing device, a plurality of solution supplying devices shown in FIG. 1 are disposed corresponding to each process solution, for example, for a color developing process, a bleaching and developing process, and a chemical rinsing process. When each process solution is divided into a plurality of part solutions, a plurality of solution supplying devices are disposed corresponding to each part solution. The operation of the solution supplying device for each of the process solutions is the same. Thus, the operation of one solution supplying device will be described.

Referring to FIG. 1, a solution supplying device 1 mainly comprises a gas-solution separation tank 60 and a solution supplying pump 40. The gas-solution separation tank 60 is a stock tank that temporarily stocks an undiluted process solution 10 supplied from a package 20 that is a vessel that packs the undiluted process solution 10. The solution supplying pump 40 supplies the undiluted process solution 10 packed in the package 20 to a processing tank 50 of an automatic developing device as the destination of the solution through the gas-solution separation tank 60. In addition to the undiluted process solution, a predetermined amount of water is supplied from a diluting water stock tank (not shown) to the processing tank 50 of the automatic developing device. The processing tank 50 compensates the undiluted process solution 10 with the water for a predetermined concentration. The compensated solution is used for the developing process. Alternatively, a sub tank may be disposed on the upstream side of the processing tank 50. In that case, the undiluted process solution and diluting water are supplied to the sub tank. After they are sufficiently mixed, the mixed solution is supplied to the processing tank 50.

The undiluted process solution 10 packed in the package 20 is sucked by the solution supplying pump 40 disposed between the gas-solution separation tank 60 and the processing tank 50 and then supplied to the processing tank 50 through a tube 30, the gas-solution separation tank 60, and a pipe 31. One edge portion 30*a* of the tube 30 is intruded into the package 20. The other edge portion of the tube 30 is connected to an upper portion of the gas-solution separation tank 60. One edge portion of the tube 31 is connected to a lower portion of the gas-solution separation tank 60. The other edge portion of the pipe 31 is connected to the processing tank 50. The solution supplying pump 40 is disposed in the middle of the pipe 31.

The package 20 is composed of a high molecular compound. The package 20 is designed so that the shape thereof varies corresponding to the amount of a solution packed therein. Thus, as the amount of the undiluted process solution 10 decreases in the package 20, the package 20 shrinks. Thus, the undiluted process solution packed in the package 20 does not contact outside air. The edge portion 30a of the tube 30 is intruded into the package 20. The undiluted process solution packed in the package 20 is supplied to the outside through the tube 30. Thus, when the material of the package 20 is properly selected as will be described later, although the edge portion 30a is intruded into the package 20, air tightness of the package 20 is kept so that the solution can be prevented from leaking out from the intruded portion and air can be prevented from entering therefrom. The undiluted process solution packed in the package 20 can be fully supplied without a deterioration thereof. To allow the edge portion 30*a* to be air-tightly intruded into the package 20, it is preferred that at least one layer of the package 20 is composed of a high molecular compound having low tensile strength. Examples of such a high molecular compound having low tensile strength are polyolefin type resin (such as polyethylene), non-stretch nylon, cellulose acetate, polyvinyl acetate, and ionomer. Among those, especially, polyolefin resin is preferably used because it has a high heat sealing characteristic for molding a vessel and because the molded vessel is strong in transportation. Typical examples of polyolefin resin are PE (polyethylene) and LLDPE (linear low density polyethylene). When one side or both sides of a high molecular compound having low tensile strength are laminated with one of the following films having high tensile strength, the gas barrier characteristic of the package 20 is improved. Examples of films having high tensile strength are ethylene-vinyl alcohol co-polymerized resin (such as EVOH), polyethylene terephthalate, stretch nylon, vinylidene chloride, polystyrene, ceramic, and aluminum.

Examples of laminate films preferably used for the package 20 according to the first embodiment are as follows (in each example, films are successively layered from the outside).

(1) Ny (stretch nylon)/LLDPE (linear low density polyethylene)
(2) Ny/PVDC (vinylidene chloride)
(3) Ny/SiOx/LLDPE
(4) Ny/EVOH/LLDPE
(5) PET(polyethylene terephthalate)/LLDPE
(6) PET/PVDC/LLDPE
(7) PET/EVOH/LLDPE Although the tube 30 is intruded into the package 20 composed of such a laminated film, the air-tightness is kept so that a solution is prevented from leaking out from the intruded portion and air is prevented from entering therefrom.

According to the first embodiment, one package 20 packs an undiluted process solution for 50 to 5000 ml that varies depending on the degree of concentration of each process solution. The tube 30 is composed of a soft material such as PVC (polyvinyl chloride) or Teflon. The inner diameter of the tube 30 is in the range from 1 to 8 mm, preferably in the range from 3 to 6 mm. The edge portion 30*a* is composed of for example a metal that is sharpened so that it can be protruded easily into the package 20.

The package 20 is installed in a tray 32 that can be slid in the X direction. When the package 20 that packs the undiluted process solution becomes empty, the package 20 is replaced with a new one. When the package 20 is replaced, an arm 33 is opened (dotted portion). In FIG. 1, the tray 32 is moved to the right. After the package 20 is replaced, while the arm 33 is open, the tray 32 is moved to the left and then the arm 33 is closed. As a result, the edge portion 30*a* of the tube 30 that pierces the arm 33 is intruded into the package 20. In that example, to improve the shock resistance, the package 20 may be contained in an outer box composed of, for example, cardboard. In that case, the package 20 that is contained in the outer box is placed on the tray 32. In addition, to prevent a package for an improper process solution from attaching the tray 32, it is preferred to dispose a miss-attachment protecting mechanism in the tray and the outer box. For example, a bump portion is formed on the bottom surface of the tray 32. A hole that fits the bump portion is formed on the outer box. Thus, unless the position of the bump portion matches the position of the hole, the package 20 cannot be installed in the tray 32. In addition, a lamp 36 is disposed on the arm 33. The lamp 36 notifies the operator that for example the package 20 should be replaced with a new one. In addition, it is preferred to dispose the following safety mechanism against the operation of the arm 33. For example, when the arm 33 is closed and then the tube 30 is intruded into the package 20, if the arm 33 is reversely moved, the tube 30 is re-intruded into the package 20. In such a situation, the air-tightness of the vessel cannot be kept. In addition, the solution may leak out from the vessel. To prevent such a situation, it is preferred to dispose a safety mechanism such as a ratchet on the arm 33 so as to prevent the arm 33 from being reversely moved after the arm 33 has been closed. In addition, it is preferred to dispose a safety mechanism such as an interlock that prevents the arm 33 from being opened and the tube 30 from coming off from the package 20 while the solution is being supplied. In other words, the interlock prevents the arm 33 from being opened until the solution contained in the package 20 runs out unless a special operation is performed.

The gas-solution separation tank 60 is composed of a pressure resisting material such as vinyl chloride, acryl, or a polycarbonate. The gas-solution separation tank 60 is formed in a rectangular parallelepiped shape whose bottom area is in the range from 3 to 30 $cm^2$ and whose height is in the range from 6 to 20 cm. According to the first embodiment, the gas-solution separation tank 60 is formed in a stair shape of which two rectangular parallelepipeds are placed on one another. According to the first embodiment, since the gas-solution separation tank 60 stocks an undiluted process solution as a spare, and whose amount is one to ten times larger than the amount of an undiluted process solution packed in one package 20. Thus, when undiluted process solution packed in the package 20 has run out, even if it is not quickly replaced with a new one, since the undiluted process solution stocked in the gas-solution separation tank 60 as a spare can be used, the developing process can be performed in predetermined quality without need to stop the developing process. Thus, the labor of the operator for the intervention of the automatic developing device can be reduced. The shape and the size of the gas-solution separation tank 60 can be varied corresponding to the structure such as the amount of extra space in the automatic developing device. According to the first embodiment, both a spare tank that stocks an undiluted process solution as a spare and a gas-solution separation tank 60 are integrated. Alternatively, the spare tank and the gas-solution separation tank may be separately disposed in such a manner that the spare tank is disposed between the gas-solution separation tank 60 and the solution supplying pump 40.

As described above, the gas-solution separation tank 60 is composed of a rectangular parallelepiped portion or a cubic portion with the above-described thickness and height. Thus, a gas that enters the flow path is quickly separated from the solution. The separated gas can be kept at an upper portion of the gas-solution separation tank 60. A gas exhaust tube 80 that is a gas exhaust mechanism is connected to an upper portion of the gas-solution separation tank 60. An air pump 70 is disposed through the gas exhaust tube 80. The air pump 70 exhausts the separated gas to the outside of the gas-solution separation tank 60. When the position of the air pump 70 is higher than the highest solution level of the gas-solution separation tank 60 and the connected position of the gas exhaust tube 80 and the gas-solution separation tank 60 is higher than the highest solution level of the gas-solution separation tank 60 by 10 mm or more, the undiluted process solution can be prevented from entering the air pump 70. In the example, the highest solution level is a solution level that is always kept while the solution is packed in the package. In other words, the highest solution level is a solution level managed by a sensor 200. In addition, a check valve 90 is connected to the gas exhaust tube 80. The check valve 90 prevents a gas from reversely flowing.

As shown in FIG. 2, the gas exhaust tube 80 is composed of a plurality of tubes 80*a* and 80*b* so that the gas exhaust tube 80 functions as a flow rate adjusting mechanism of the air pump. The inner diameter of the tube 80*a* is 4 mm. The inner diameter of the tube 80*b* is 0.5 mm. The length of the tube 80*b* is in the range from 3 to 10 cm. The tube 80*b* is disposed in the middle of the tube 80*a*. In the gas exhaust flow rate in the structure shown in FIG. 2 is lower than that in the structure of which only one gas exhaust tube whose inner diameter is 4 mm is used. In other words, when the thickness and length of tubes are varied corresponding to the force of the air pump 70, the gas exhaust flow rate can be adjusted to a predetermined value. The gas exhaust flow rate of the gas that is exhausted from the gas-solution separation tank 60 is for example in the range from 10 to 2500 ml per minute, preferably, in the range from 100 to 1500 ml per minute. According to the first embodiment, the gas exhaust flow rate is in the range from around 1.0 to 2.5 l per minute. In reality, when an exhaust air pump that is commercially available and whose gas exhaust flow rate is 3 l per minute and a tube of which a plurality of tubes whose diameters are different are connected is used, the gas exhaust flow rate becomes in the range from 1.0 to 2.5 l per minute. Thus, when only a commercially available pump is used, since the gas flow rate is too high, the undiluted process solution may reversely flow. However, when a narrow tube is interposed in the middle of a regular tube, a flow rate loss actively takes place. As a result, the gas exhaust flow rate can be adjusted. Alternatively, as a means for causing a flow rate loss to actively take place, for example a needle value or a ball valve can be used as the gas exhaust flow rate adjusting mechanism according to the present invention.

As a pressure varying portion that varies the gas pressure in the stock tank, an overpressure release valve 100 is disposed at an upper portion of the gas-solution separation tank 60. When the inner pressure of the gas-solution separation tank 60 becomes a predetermined value or lower, the overpressure release valve 100 is operated. After the undiluted process solution 10 packed in the package 20 has been fully sucked, when the undiluted process solution stocked in the gas-solution separation tank 60 is supplied to the processing tank 50 by the solution supplying pump 40, a gas starts expanding in the gas-solution separation tank 60. When the gas further expands in the gas-solution separation tank 60, a negative pressure takes place in the gas-solution separation tank 60. When the undiluted process solution reaches a predetermined solution level, the solution supplying pump 40 cannot suck it anymore. To solve such a problem, a solution supplying pomp having a large flow rate may be used. However, in that case, the size of the solution supplying device becomes large. Thus, the installation position of the solution supplying device is adversely restricted. Thus, according to the first embodiment, the overpressure release valve 100 is disposed. The overpressure release valve 100 is operated when the inner pressure of the gas-solution separation tank 60 becomes a predetermined value or lower. As a result, a solution supplying pump 40 having a low power can be used. In reality, before the inner pressure of the gas-solution separation tank 60 is balanced with the sucking force of the solution supplying pump 40, the overpressure release valve 100 is operated so as to prevent the gas-solution separation tank 60 from excessively pressure-reduced.

As shown in FIGS. 3A and 3B, the overpressure release valve 100 opens and closes a hole 60a provided at an upper portion of the gas-solution separation tank 60 so as to adjust the inner pressure of the gas-solution separation tank 60. As shown in FIGS. 3A and 3B, the overpressure release valve 100 is composed of a shaft 102, a packing 101, a support member 103, and a spring 104. The shaft 102 has a smaller sectional area than the hole 60*a*. The packing 101 is disposed at one edge portion of the shaft 102. The support member 103 is disposed at the other edge portion of the shaft 102. The spring 104 is disposed between the packing 101 and the support member 103 in such a manner that the spring 104 surrounds the shaft 102. The overpressure release valve 100 is disposed in such a manner that the shaft 102 pierces the hole 60*a* and the packing 101 is placed in the gas-solution separation tank 60. When the overpressure release valve 100 is not operated, as shown in FIG. 3A, the hole 60*a* is covered with the packing 101. Thus, the gas-solution separation tank 60 is kept in the air-tight state. In contrast, when the overpressure release valve 100 is operated, as shown in FIG. 3B, the overpressure release valve 100 is pulled toward the gas-solution separation tank 60. As a result, the spring 104 shrinks. The packing 101 is separated from the gas-solution separation tank 60. At that point, due to the presence of the spring 104, a space is formed between the overpressure release valve 100 and the gas-solution separation tank 60. Thus, outside air enters the gas-solution separation tank 60 through the hole 60*a*. As a result, the excessively reduced pressure state dissolves in the gas-solution separation tank 60. Thereafter, the spring 104 expands as shown in FIG. 3A. As a result, the gas-solution separation tank 60 restores to the air-tight state. The operation of the overpressure release valve 100 against the reduced pressure in the gas-solution separation tank 60 can be adjusted by strength of the spring 104. A practical pressure value for the overpressure release valve 100 to operate depends on the shape of the gas-solution separation tank 60 and the flow rate of the solution supplying pump. Thus, when the solution supplying device is designed, the spring 104 is adjusted in such a manner that the sucking force of the solution supplying pump 40 is not balanced with the inner pressure of the gas-solution separation tank 60.

According to the first embodiment, four sensors 200 to 203 are disposed in the gas-solution separation tank 60. The sensor 200 is a sensor that operates when the amount of the process solution stocked in the gas-solution separation tank 60 exceeds a predetermined value. The sensor 201 is an entrained gas sensor that operates when the amount of a gas that gathers at the upper portion of the gas-solution separation tank 60 exceeds a predetermined value. The sensor 202 is a sensor that operates when the undiluted process solution stocked in the package 20 has run out. The sensor 203 is a sensor that operates when the undiluted process solution stocked in the gas-solution separation tank 60 has run out. sensors that can detect solution levels can be used. According to the first embodiment, float sensors are used as the sensors 200 to 203. As shown in FIG. 4, each of the sensors 200 to 203 is composed of a float 211 and a sensing portion 212. When the undiluted process solution 10 reaches the position of each sensor of the gas-solution separation tank 60, the buoyancy of the float 211 causes the float 211 to contact the sensing portion 212. When a gas reaches a float sensor position, the float 211 separates from the sensing portion 212. Thus, a signal that is output from the sensor is sent to a controlling portion (not shown). The controlling portion starts and stops the air pump 70, stops the solution supplying pump 40, and lights the lamp 36.

The flow rate of the solution supplying pump 40 may be in the range for example from 15 to 200 ml per minute. According to the first embodiment, the solution supplying pump 40 may be a bellows pump whose flow rate is 30 ml per minute. The pipe 31 connected to the gas-solution separation tank 60 through the solution supplying pump 40 is composed of a soft material such as PVC (polyvinyl chloride) or Teflon. The inner diameter of the pipe 31 is in the range from 1 to 8 mm, preferably in the range from 3 to 6 mm.

Figure 5:
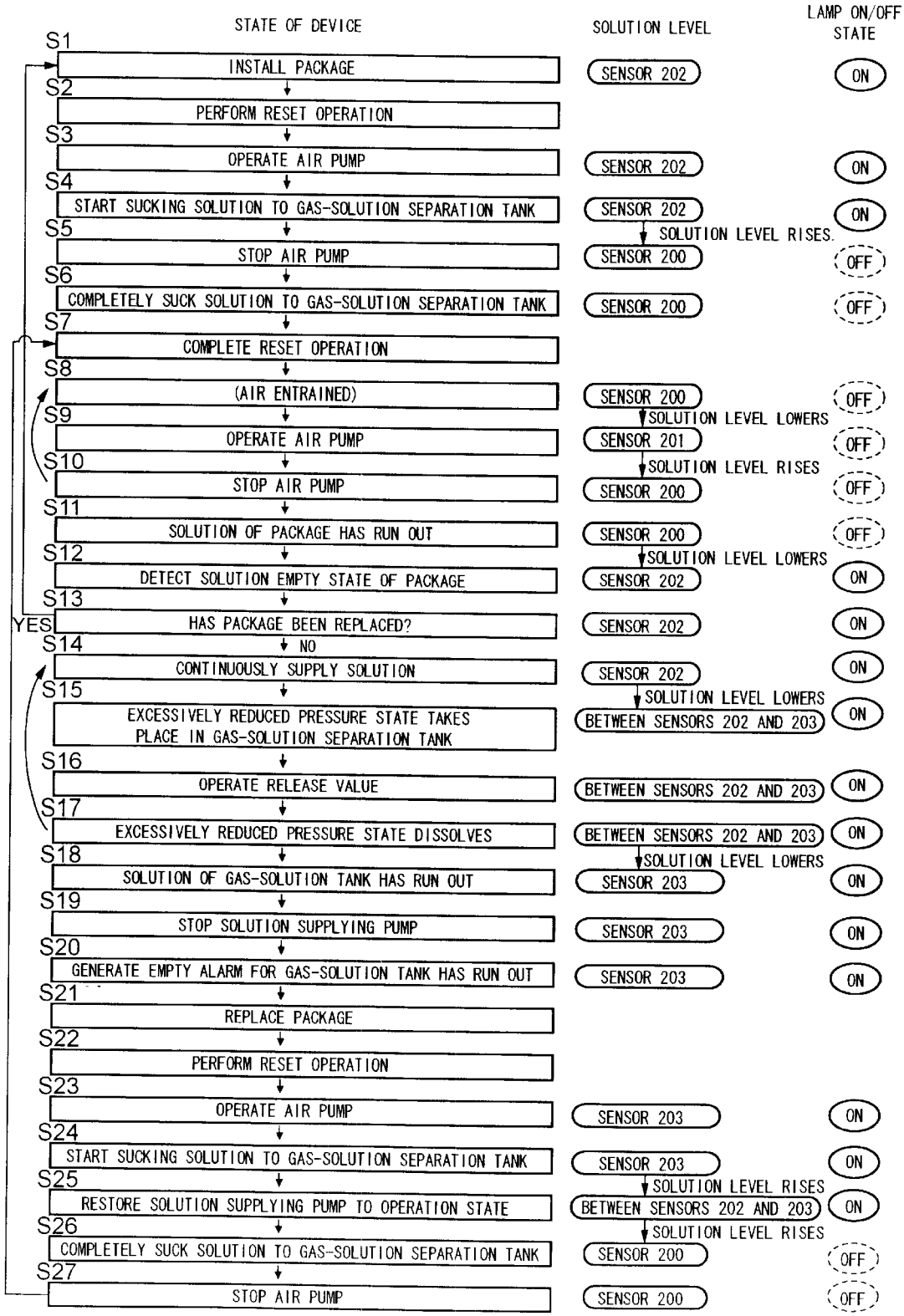
FIG. 5 is a flow chart showing the operation states of the solution supplying device, the solution levels of an undiluted process solution in a gas-solution separation tank in the individual operation state, and lamp on-off states.
Figure 6B:
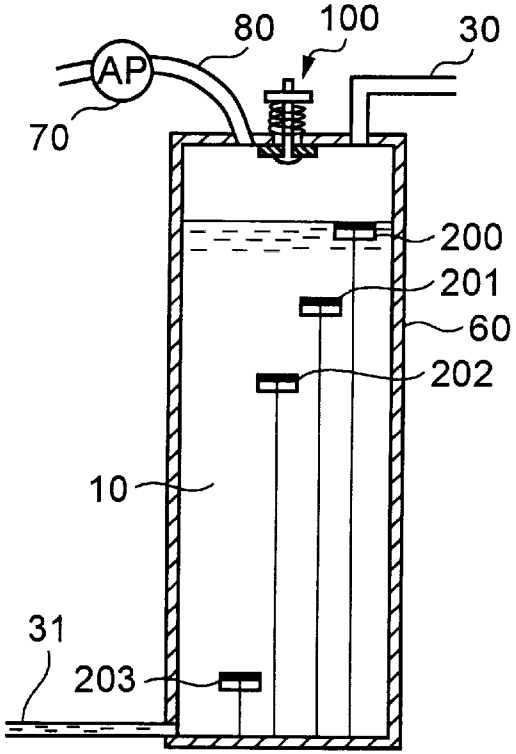
FIGS. 6A and 6B are schematic diagrams for explaining the operations of sensors corresponding to the solution levels of the undiluted process solution in the gas-solution separation tank.
Figure 6A:
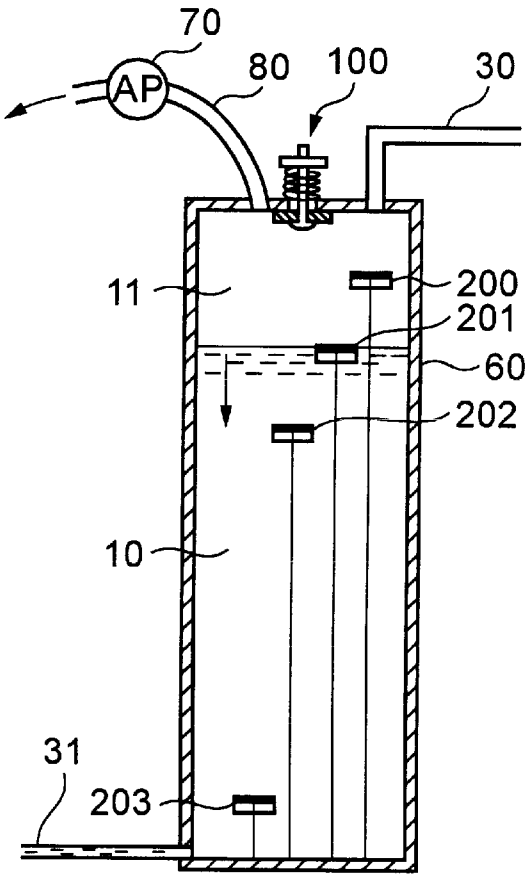
Figure 7B:
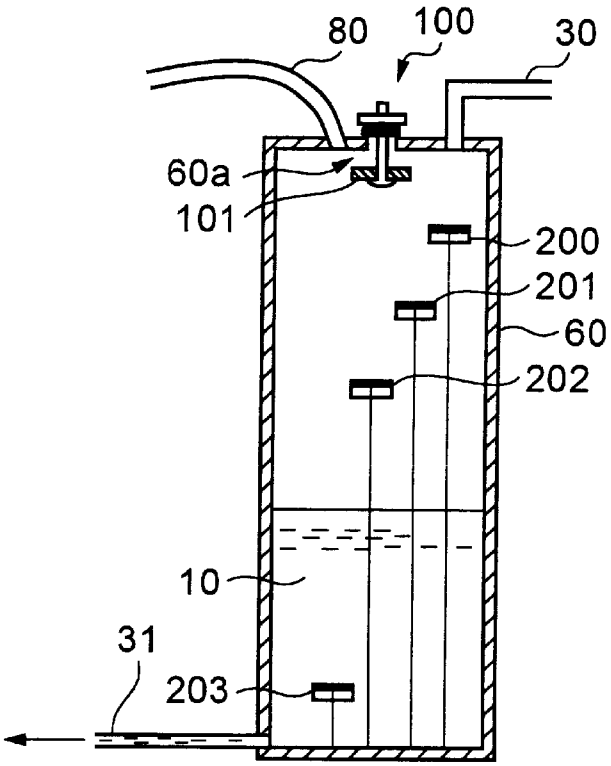
FIGS. 7A and 7B are schematic diagrams for explaining the operations of the sensors corresponding to the solution levels of the undiluted process solution in the gas-solution separation tank.
Figure 7A:
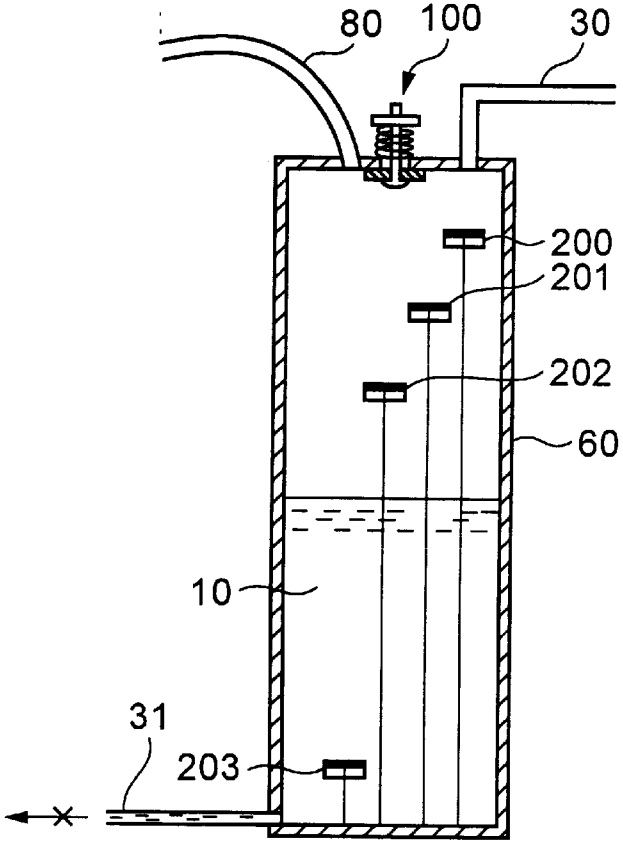

Next, with reference to FIGS. 5 to 7, the operation of the solution supplying device 1 according to the first embodiment will be described. FIG. 5 is a flow chart showing the operation states of the solution supplying device, the levels of an undiluted process solution in the gas-solution separation tank in the individual states, and lamp on/off states. FIGS. 6A, 6B, 7A, and 7B are schematic diagrams for explaining the operations of sensors corresponding to the solution levels of the undiluted process solution of the gas-solution separation tank 60. Next, with reference to the flow chart shown in FIG. 5 and the schematic diagrams shown in FIGS. 6A, 6B, 7A, and 7B, the operation states of the solution supplying device 1 will be described.

The case that after the undiluted process solution in the package 20 installed in the tray 32 has run out, the package 20 is quickly replaced with a new one will be described. In the case, a new package 20 is installed in the solution supplying device 1 (at step S1). At that point, the undiluted process solution is stocked as a spare in the gas-solution separation tank 60. The solution level of the undiluted process solution stocked in the gas-solution separation tank 60 is at the position of the float sensor 202. When necessary, the solution supplying pump 40 can be operated. Thus, the undiluted process solution stocked in the gas-solution separation tank 60 as a spare can be supplied continuously to the processing tank 50. Thus, even if the developing process is performed in the automatic developing device while the package 20 is being replaced with a new one, the undiluted process solution can be replenished properly. In addition, the lamp 36 lights. The overpressure release valve 100 causes the hole 60*a* to be closed and thereby the gas-solution separation tank 60 to be in the air-tight state.

After the new package 20 is installed in the tray 32, when the reset operation is performed (for example, the reset button is pressed), the air pump 70 is started (at steps S2 and S3). The air pump 70 sucks the undiluted process solution packed in the package 20 to the gas-solution separation tank 60 (at step S4). When the undiluted process solution supplied to the gas-solution separation tank 60 reaches the position of the float sensor 200, a signal that is output from the float sensor 200 is sent to the controlling portion (not shown). The controlling portion causes the air pump 70 to stop sucking the undiluted process solution. After the undiluted process solution has been sucked, the reset operation necessary for replacing the package is completed. Thereafter the lamp 36 is put off (at steps S5, S6, and S7). After the reset operation has been completed, the solution supplying pump 40 is operated corresponding to a replenishment request for the processing tank 50. The solution supplying pump 40 sucks the undiluted process solution from the package 20. The undiluted process solution is supplied from the package 20 to the processing tank 50 through the gas-solution separation tank 60. As the amount of the undiluted process solution packed in the package 20 decreases, the package 20 shrinks.

When the package 20 contains air or a solution that has been packed in the package 20 for a long time produces a gas, the air or gas is also sucked as an entrained gas 11 as the solution is supplied. As a result, the entrained gas 11 enters the flow path (at step S8). The entrained gas 11 quickly separates from the solution in the gas-solution separation tank 60 and gathers at an upper portion of the gas-solution separation tank 60. As shown in FIG. 6A, as the amount of gas that gathers at the upper portion of the gas-solution separation tank 60 increases, the solution level lowers from the position of the float sensor 200. When the solution level reaches the position of the float sensor 201, it detects the decrease of the solution level. Thus, a signal that is output from the float sensor 201 is sent to the controlling portion (not shown). The controlling portion causes the air pump 70 to operate (at step S9).

When the air pump 70 is operated, the gas 11 is exhausted from the gas-solution separation tank 60 to the outside. As a result, the solution level of the undiluted process solution 10 rises. As shown in FIG. 6B, when the solution level reaches the position of the float sensor 200, it detects the increase of the solution level. A signal that is output from the float sensor 200 is sent to the controlling portion (not shown). The controlling portion causes the air pump 70 to stop (at step S10). When the gas 11 enters the gas-solution separation tank 60, the operation from steps S8 to S10 is repeated.

When the undiluted process solution 10 is further supplied, the undiluted process solution 10 packed in the package 20 runs out (at step S11).

Thereafter, while the undiluted process solution 10 packed in the package 20 has run out, when the operation of the solution supplying pump 40 is continued, a negative pressure state takes place in the gas-solution separation tank 60. When the gas in the gas-solution separation tank 60 expands, the solution level lowers to the position of the float sensor 202. The float sensor 202 detects the gas. As a result, a signal form the float sensor 202 is sent to the controlling portion (not shown). The controlling portion causes the lamp 36 to light (at step S12) notifying the operator that the package 20 should be replaced with a new one. According to the first embodiment, the lamp 36 is used. Alternatively, a buzzer may be used to notify the operator that the package 20 should be replaced with a new one. In the solution empty state detecting operation for the package 20, when the solution level of the undiluted process solution stocked in the gas-solution separation tank 60 lowers to the position of the float sensor 201, the air pump 70 is started. The air pump 70 only increases the negative pressure, not affects the solution empty state detecting operation. When the solution level lowers to the position of the float sensor 202, the air pump 70 may be stopped. Alternatively, when a predetermined time period elapses after the air pump 70 is operated, the air pump 70 may be stopped. The lamp 36 still lights until the new package is installed.

At that point, when the package 20 is replaced with a new one (namely, the determined result at step S13 is Yes), the flow returns to step S1. At step S1, the above-described operation is repeated. When the package 20 is replaced with a new one, since outside air enters the gas-solution separation tank 60 through the edge portion 30*a* of the tube 30, the negative pressure state of the gas-solution separation tank 60 dissolves.

On the other hand, when the package 20 is not replaced with a new one (namely, the determined result at step S13 is No) and the undiluted process solution is continuously supplied from the gas-solution separation tank 60 to the processing tank 50 by the solution supplying pump 40, an excessively reduced pressure state takes place in the gas-solution separation tank 60. At a particular point, the sucking force of the solution supplying pump 40 is balanced with the inner pressure of the gas-solution separation tank 60. As a result, as shown in FIG. 7A, the undiluted process solution 10 cannot be sucked from the gas-solution separation tank 60 anymore (at step S15). At that point, the solution level of the undiluted process solution 10 is at the position for example between the float sensor 202 and the float sensor 203.

To prevent the suction disable state, the spring tension of the overpressure release valve 100 is adjusted so that just before such a state takes place due to the decrease in inner pressure of the gas-solution separation tank 60, the overpressure release valve 100 is operated. Thus, when a predetermined excessively reduced pressure state takes place in the gas-solution separation tank 60, as shown in FIG. 7B, the overpressure release valve 100 is operated (at step S16). The overpressure release valve 100 causes the packing 101 to be separated from the gas-solution separation tank 60. Thus, outside air enters the gas-solution separation tank 60 through the hole 60*a*. Consequently, the excessively reduced pressure state dissolves in the gas-solution separation tank 60 (at step S17). Thus, even if the solution supplying pump 40 is a small pump, it can stably supply the undiluted process solution without an occurrence of the solution supply disable state. After the excessively reduced pressure state dissolves in the gas-solution separation tank 60, the overpressure release valve 100 is restored to the state shown in FIG. 7A. As a result, the undiluted process solution is continued to be supplied. When the excessively reduced pressure state takes place in the gas-solution separation tank 60, the overpressure release valve 100 is operated. Thus, the excessively reduced pressure state dissolves in the gas-solution separation tank 60 (at steps S15 to S17).

Thereafter, the undiluted process solution 10 is further supplied to the processing tank 50. When the solution level in the gas-solution separation tank 60 reaches the position of the float sensor 203 (at step S18), the float sensor 203 detects a gas. Thus, a signal that is output from the float sensor 203 is sent to the controlling portion (not shown). The controlling portion causes the solution supplying pump 40 and the air pump 70 to stop (at step S19). Thereafter, for example a buzzer generates an alarm sound that notifies the operator that the undiluted process solution 10 stocked in the gas-solution separation tank 60 has run out (at step S20). The package 20 is replaced with a new one accordingly. (at step S21). Unlike the reset operation from steps S1 to S6, when the solution level lowers to the position of the float sensor 203, the solution supplying pump 40 is forcedly stopped so as to prevent air that enters the solution supplying pump 40 from deteriorating the solution supply accuracy thereof. Thus, in the reset operation performed after the solution level of the undiluted process solution 10 lowers to the position of the float sensor 203, the solution supplying pump 40 is restored to the operation state. In reality, the reset operation is performed. For example, after the package 20 is replaced, the reset button is pressed (at step S22). Thus, the air pump 70 is started (at step S23). The air pump 70 sucks the undiluted process solution packed in the package 20 to the gas-solution separation tank 60 (at step S24). When the solution level of the undiluted process solution rises above the position of the float sensor 203, the float 211 of the float sensor 203 contacts the sensing portion 212 due to the buoyancy of thereof. Thus, the float sensor 203 detects the increase of the solution level. As a result, a signal that is output from the float sensor 203 is sent to the controlling portion. The controlling portion causes the solution supplying pump 40 to restore to the operation state (at step S25). At that point, the amount of the undiluted process solution that is replenished until the solution supplying pump 40 is stopped due to the solution empty state detected in the gas-solution separation tank 60 may be memorized to a computing portion (not shown). Thus, when the solution supplying pump 40 is restored to the operation state, the amount of the undiluted process solution that was consumed is replenished. When the air pump 70 causes the undiluted process solution to be supplied to the gas-solution separation tank 60 until the solution level of the undiluted process solution reaches the position of the float sensor 200, a signal that is output from the float sensor 200 is sent to the controlling portion (not shown). The controlling portion causes the air pump 70 to stop. Thus, the operation for sucking the undiluted process solution is completed and thereby the lamp 36 is put off (at steps S26 and S27). When the capacity of the gas-solution separation tank 60 is large and the amount of the undiluted process solution contained in the space between the positions of the float sensor 203 and the float sensor 200 in the gas-solution separation tank 60 is equal to or larger than the amount of the undiluted process solution packed in one package 20, even if the all amount of the undiluted process solution packed in one package 20 is sucked, since the solution level of the undiluted process solution does not reach the position of the float sensor 200, the lamp 36 remains on, notifying the operator that the package 20 can be still replaced with a new one. When the capacity of the gas-solution separation tank 60 is several times larger than the capacity of one package 20, the operation of the air pump 70 is controlled corresponding to time. After a predetermined time period necessary for sucking the undiluted process solution from one package elapses, the air pump 70 may be automatically stopped. In that case, when the operator is not busy, the remaining undiluted process solution can be sucked. At that point, since the liquid supplying pump has been restored to the operation state, the undiluted process solution can be accurately replenished as usual.

When the solution level of the gas-solution separation tank 60 reaches the position of the float sensor 200, the reset operation necessary for replacing the package is completed. After the reset operation is completed, the flow returns to step S7. At step S7, the above-described operation is repeated. When the solution level of the undiluted process solution stocked in the gas-solution separation tank 60 is at a position between the float sensor 202 and the float sensor 203 (before the loop of steps S14 to S18), the package 20 can be replaced with a new one anytime. Thus, since the package 20 can be replaced without need to stop the solution supplying pump 40, the reset operation of the loop from steps S1 to S7 can be performed.

(Second Embodiment)

Next, with reference to FIG. 8, a second embodiment of the present invention will be described.

According to the first embodiment, the overpressure release valve was used as the pressure varying portion. However, it should be noted that the pressure varying portion may be structured so that the volume of a part of a gas-solution separation tank is varied as long as an excessively reduced pressure state that takes place in the gas-solution separation tank can dissolve.

Figure 8:
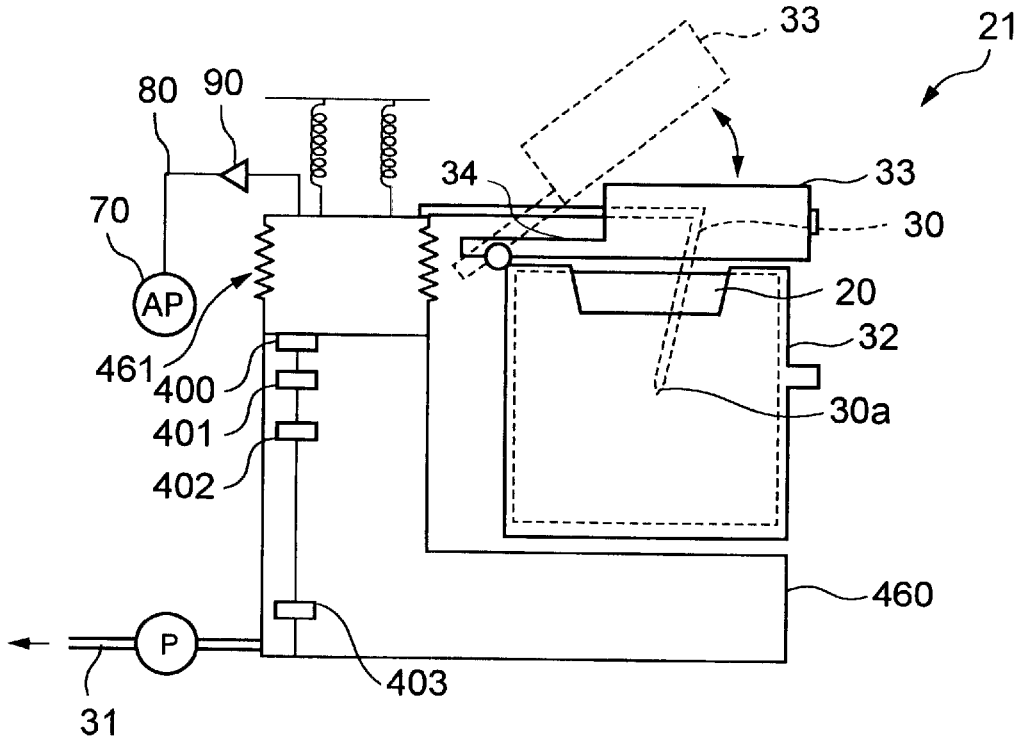
FIG. 8 is a schematic diagram showing the structure of a solution supplying device according to a second embodiment of the present invention.

FIG. 8 is a schematic diagram showing the structure of a solution supplying device 21. For simplicity, in FIG. 8, similar portions to those of the first embodiment shown in FIG. 1 are denoted by similar reference numerals and their redundant description is omitted.

A gas-solution separation tank 460 of the solution supplying device 21 according to the second embodiment has a volume varying chamber 461. The volume varying chamber 461 is disposed at an upper portion of the gas-solution separation tank 460. The volume varying chamber 461 has a bellows portion. The bellows portion of the volume varying chamber 461 expands and shrinks so as to vary the volume and the inner pressure of the gas-solution separation tank 460.

The gas-solution separation tank 460 has four sensors 400 to 403. The sensor 400 is a sensor that operates when the amount of the undiluted process solution stocked in the gas-solution separation tank 460 exceeds a predetermined value. The sensor 401 is an entrained gas sensor that operates when a gas that gathers at the upper portion of the gas-solution separation tank 460 exceeds a predetermined value. The sensor 402 is a sensor that detects the solution empty state of the undiluted process solution stoked in the package 20. The sensor 403 is a sensor that detects the solution empty state of the undiluted process solution of the gas-solution separation tank 460. Like the first embodiment, the sensors 400 to 403 are float sensors.

Figure 9A:
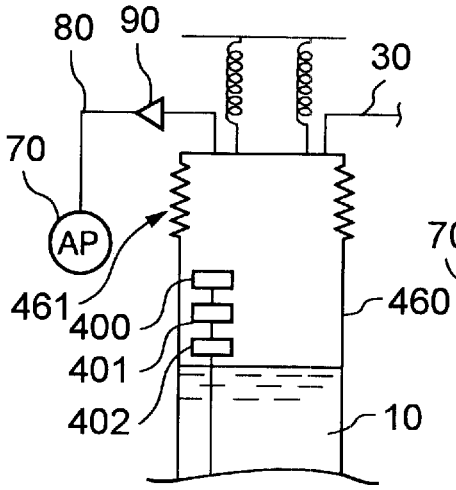
FIGS. 9A and 9B are schematic diagrams for explaining the operation of the solution supplying device according to the second embodiment.

Next, with reference to FIGS. 9A and 9B, the operation of the volume varying chamber 461 will be described. As shown in FIG. 9A, while the undiluted process solution is being supplied to the processing tank 50, the bellows portion of the volume varying chamber 461 expands. When the undiluted process solution is continuously supplied to the gas-solution separation tank 460, if the package 20 is not replaced with a new one, an excessively reduced pressure state takes place in the gas-solution separation tank 460. At a particular point, the sucking force of the solution supplying pump 40 is balanced with the inner pressure of the gas-solution separation tank 460. Thus, the undiluted process solution 10 cannot be sucked from the gas-solution separation tank 460.

Figure 9B:
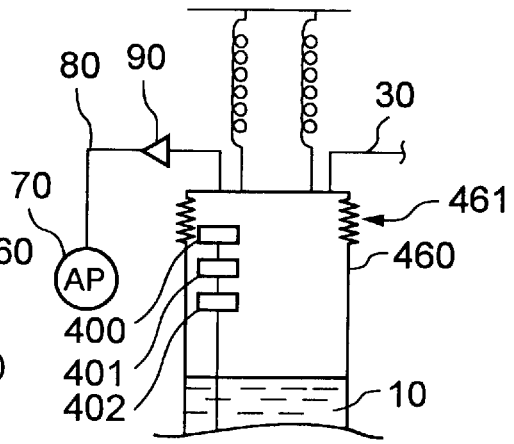

As shown in FIG. 9B, before the suction disable state takes place, the bellows portion of the volume varying chamber 461 shrinks. Thus, the volume of the gas-solution separation tank 460 decreases. Thus, the excessively reduced pressure state dissolves in the gas-solution separation tank 460 without outside air. Consequently, the solution supplying pump 40 can continuously supply the undiluted process solution 10 from the gas-solution separation tank 460 to the processing tank 50.

Figure 10:
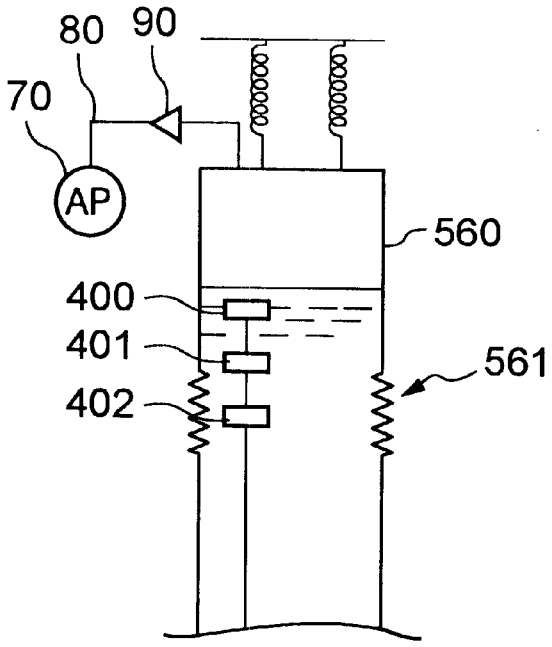
FIG. 10 is a schematic diagram showing the structure of a solution supplying device according to a modification of the present invention.
Figure 11:
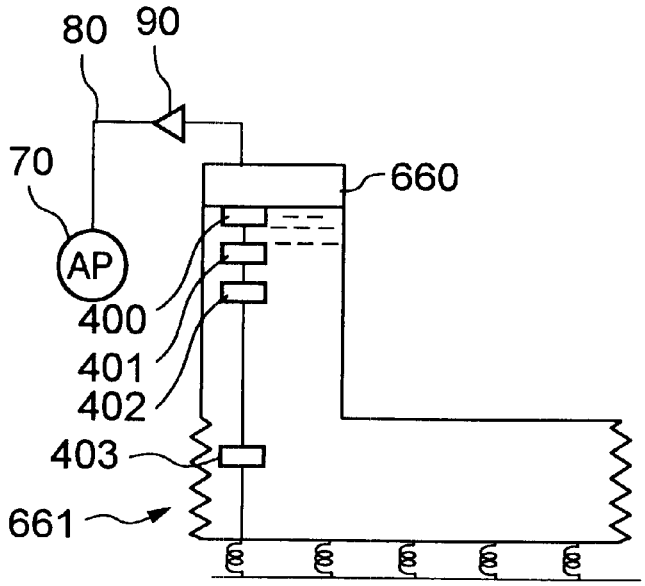
FIG. 11 is a schematic diagram showing the structure of a solution supplying device according to another modification of the present invention.

According to the second embodiment, the upper portion of the gas-solution separation tank 460 is the volume varying chamber 461 structured as a bellows portion. However, it should be noted that the position of the volume varying chamber 461 is not limited to the upper portion. For example, as shown in FIG. 10, a volume varying chamber 561 structured as a bellows portion may be disposed at a center portion of a gas-solution separation tank 560. Alternatively, as shown in FIG. 11, a volume varying chamber 661 structured as a bellows portion may be disposed at a lower portion of a gas-solution separation tank 660.

Figure 12:
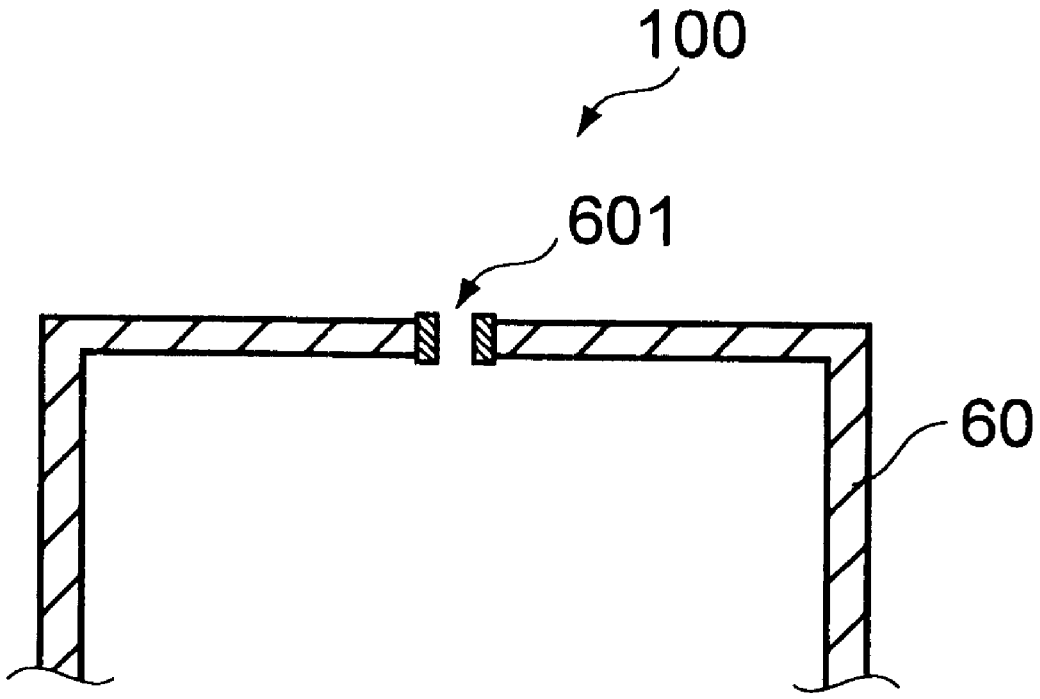
FIG. 12 is a schematic diagram showing the structure of a solution supplying device according to another modification of the present invention.

In addition, as shown in FIG. 12, an orifice 601 may be used instead of the overpressure release valve as a pressure varying portion. Like the overpressure release valve, the inner diameter of the orifice 601 is designated so that when the inner pressure of the gas-solution separation tank 60 is lower than a predetermined value, outside air enters the gas-solution separation tank 60. For example, according to the second embodiment, the inner diameter of the orifice 601 is preferably 2.00 mm or less, more preferably in the range from 0.1 mm to 0.5 mm. Thus, the inner pressure of the gas-solution separation tank 60 can be adjusted with a very simple structure.

(Third Embodiment)

Next, a third embodiment of the present invention will be described.

Figure 13:
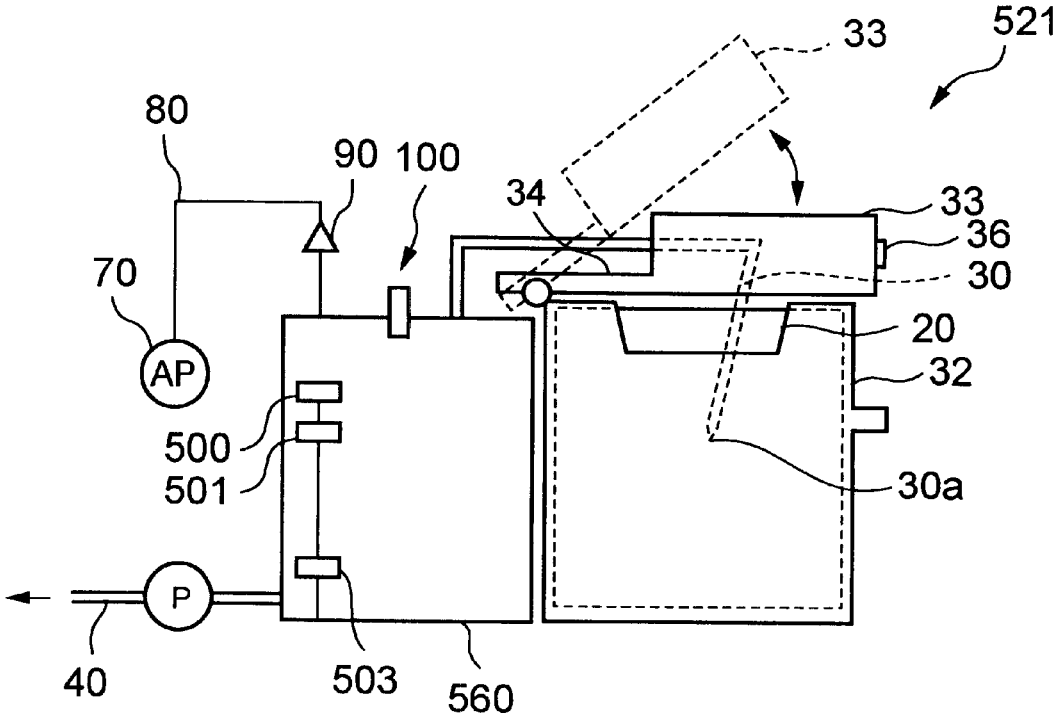
FIG. 13 is a schematic diagram showing the structure of a solution supplying device according to a third embodiment of the present invention.

According to the above-described embodiments, the capacity of the gas-solution separation tank is more than two times as large as the capacity of one package. In contrast, according to the third embodiment, as shown in FIG. 13, the capacity of the gas-solution separation tank is equal to the capacity of one package. Thus, the size of the gas-solution separation tank can be varied corresponding to the installation space thereof.

As shown in FIG. 13, the structure of a solution supplying device 521 according to the third embodiment is the same as the structure of the solution supplying device 1 according to the first embodiment except for the sizes of the gas-solution separation tanks. Thus, for simplicity, in FIG. 13, similar portions to those in FIG. 1 are denoted by similar reference numerals and their redundant description is omitted.

A gas-solution separation tank 560 of the solution supplying device 521 has three sensors 500, 501, and 503. The sensor 500 is a sensor that operates when the amount of the undiluted process solution stocked in the gas-solution separation tank 560 exceeds a predetermined value. The sensor 501 is an entrained gas sensor that operates when the amount of a gas that gathers at an upper portion of the gas-solution separation tank 560 exceeds a predetermined value. The sensors 500 and 501 are sensors that operate in the same manner as the sensors 200 and 201 according to the first embodiment. The sensor 503 is a sensor that operates when both the undiluted process solution of the package 20 and the undiluted process solution of the gas-solution separation tank 560 run out. Like the first embodiment, the sensors 500, 501, and 503 are float sensors.

According to the third embodiment, when the undiluted process solution packed in the package 20 has run out, if the undiluted process solution is still supplied from the gas-solution separation tank 560 to the processing tank, an excessively reduced pressure state takes place in the gas-solution separation tank 560. At a particular point, the sucking force of the solution supplying pump 40 is balanced with the inner pressure of the gas-solution separation tank 560. Thus, the undiluted process solution 10 stocked in the gas-solution separation tank 560 cannot be sucked anymore. At that point, the solution level of the undiluted process solution 10 stocked in the gas-solution separation tank 560 is at a position for example between the sensor 501 and the sensor 503.

To prevent the suction disable state, the spring tension of the overpressure release valve 100 is adjusted so that just before such a state takes place due to the inner pressure of the gas-solution separation tank 560, the overpressure release valve 100 is operated. Thus, like the first embodiment, when an excessively reduced pressure state takes place in the gas-solution separation tank 560, the overpressure release valve 100 is operated and thereby outside air enters the gas-solution separation tank 560. As a result, the excessively reduced pressure state dissolves in the gas-solution separation tank 560. Thus, even if the solution supplying pump 40 is small pump, it can stably supply the undiluted process solution without an occurrence of the solution supply defect state.

When the undiluted process solution 10 is further supplied, the solution level of the undiluted process solution 10 stocked in the gas-solution separation tank 560 reaches the position of the sensor 503. At that point, the sensor 503 detects a gas. As a result, a signal that is output from the sensor 503 is sent to the controlling portion (not shown). The controlling portion causes the air pump 70 to stop. At that point, a buzzer generates an alarm sound as a solution empty state alarm for the gas-solution separation tank 560. The alarm notifies the operator that the undiluted process solution stocked in the gas-solution separation tank 560 and the undiluted process solution packed in the package 20 run out. According to the alarm, the package 20 is replaced with a new one.

As a modification of the third embodiment, the over pressure release value of the pressure varying portion may be a solenoid valve. The solenoid valve is interlocked with the solution level sensor or the inner pressure sensor of the gas-solution separation tank. Thus, with the solenoid valve, the excessively reduced pressure state can dissolve in the gas-solution separation tank. The sensors that detect solution levels may be for example photoelectric sensors or photo-micro sensors rather than float sensors.

As was described above, when a pressure varying portion such as an overpressure release valve is disposed, even if a small solution supplying pump is used, the solution can be stably and accurately supplied. Thus, the size of the solution supplying device can be reduced. In addition, when a stock tank and a gas exhausting portion (such as an air pump) are disposed, the frequency of which the package is replaced decreases. Thus, the solution supplying device can be prevented from malfunctioning due to an entrained gas. When a flow rate adjusting mechanism is disposed in the air pump, a trouble of which the solution reversely flows to the air pump can be prevented.

(Fourth Embodiment)

Next, a fourth embodiment of the present invention will be described.

Figure 14:
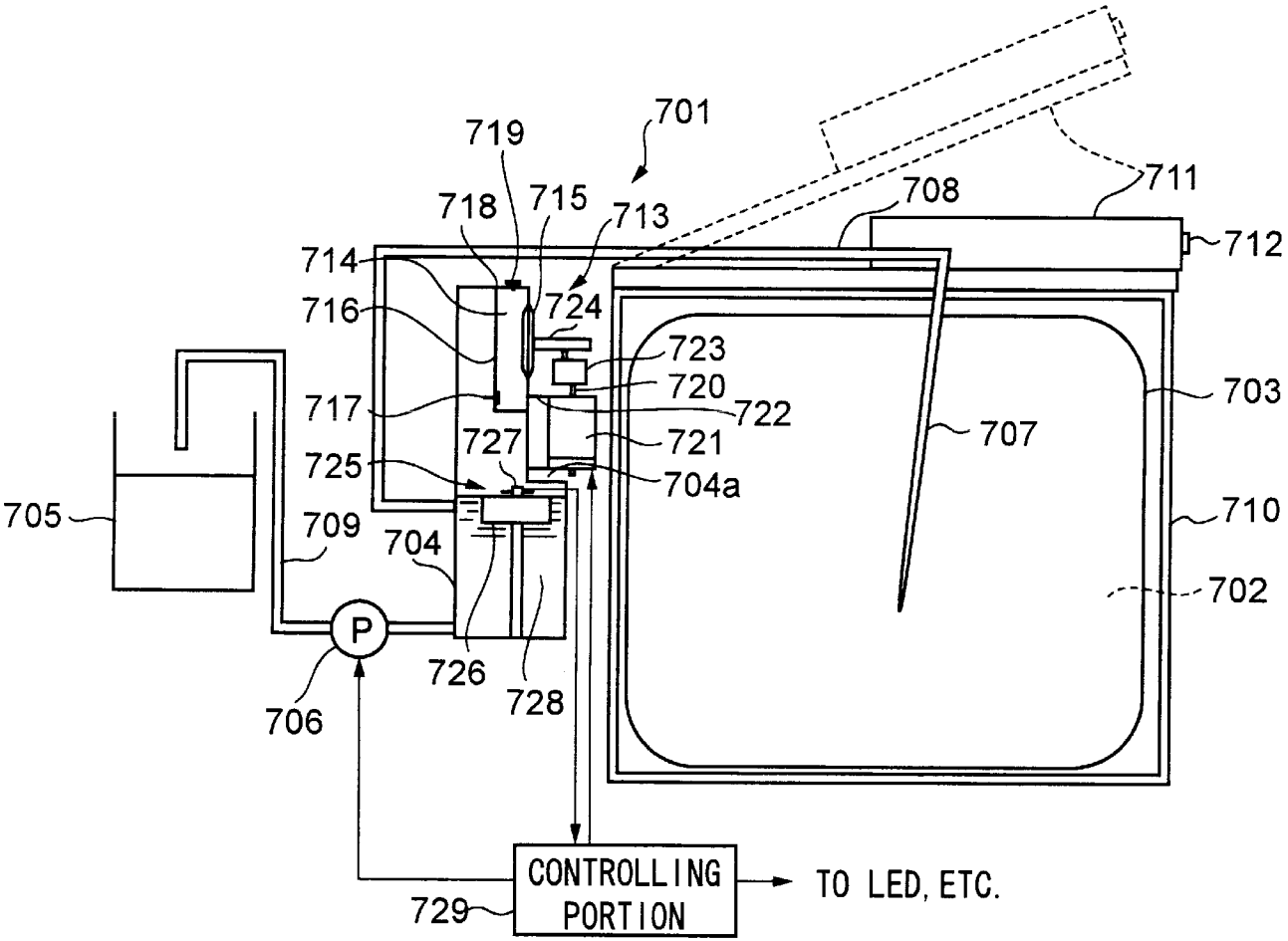
FIG. 14 is a schematic diagram showing the structure of a solution supplying device according to a fourth embodiment of the present invention.

FIG. 14 is a sectional view showing the outlined structure of a solution supplying device according to the fourth embodiment of the present invention.

Referring to FIG. 14, a solution supplying device 701 mainly comprises a stock tank 704 and a solution supplying pump 706. The stock tank 704 temporarily stocks an undiluted process solution 702 supplied from a package 703 as a vessel that packs the undiluted process solution 702. The stock tank 704 also separates a gas from the solution. The solution supplying pump 706 is composed of for example a bellows pump that supplies the undiluted process solution 702 packed in the package 703 to a processing tank 705 of the automatic developing device as a destination through the stock tank 704. In addition to the undiluted process solution, a predetermined amount of water is supplied from a diluting water stock tank (not shown) to the processing tank 705 of the automatic developing device. The processing tank 705 compensates the undiluted process solution with the supplied water for a predetermined concentration. The diluted process solution is used for the developing process. A sub tank may be disposed on the upstream side of the processing tank 705. In that case, the undiluted process solution and the diluting water are supplied to the sub tank. After they are sufficiently mixed, the diluted process solution is supplied to the processing tank 705.

The undiluted process solution 702 packed in the package 703 is sucked by the solution supplying pump 706 disposed between the stock tank 704 and the processing tank 705 and supplied to the processing tank 705 through a probe 707, a tube 708, the stock tank 704, and a tube 709. The probe 707 is disposed at one edge portion of the tube 708. The probe 707 is intruded into the package 703. The other edge portion of the tube 708 is connected to an upper portion of the stock tank 704. One edge portion of the tube 709 is connected to a lower portion of the stock tank 704. The other edge portion of the tube 709 is connected to the processing tank 705. The solution supplying pump 706 is disposed in the middle of the tube 709. Each member of the fourth embodiment can be structured in the same manner as the first embodiment. A tray 710, an arm 711, and an LED 712 of the fourth embodiment are the same as those of the first embodiment.

The stock tank 704 is composed of a pressure resisting material such as vinyl chloride, acryl, or polycarbonate. The stock tank 704 has a shoulder portion 704a that faces the package 703. The capacity of the stock tank 704 is preferably around 100 ml. An air pump 713 is integrated with the stock tank 704. The air pump 713 forcedly exhausts a gas that gathers at an upper portion of the stock tank 704 so as to prevent the solution empty state from being incorrectly detected.

Figure 15:
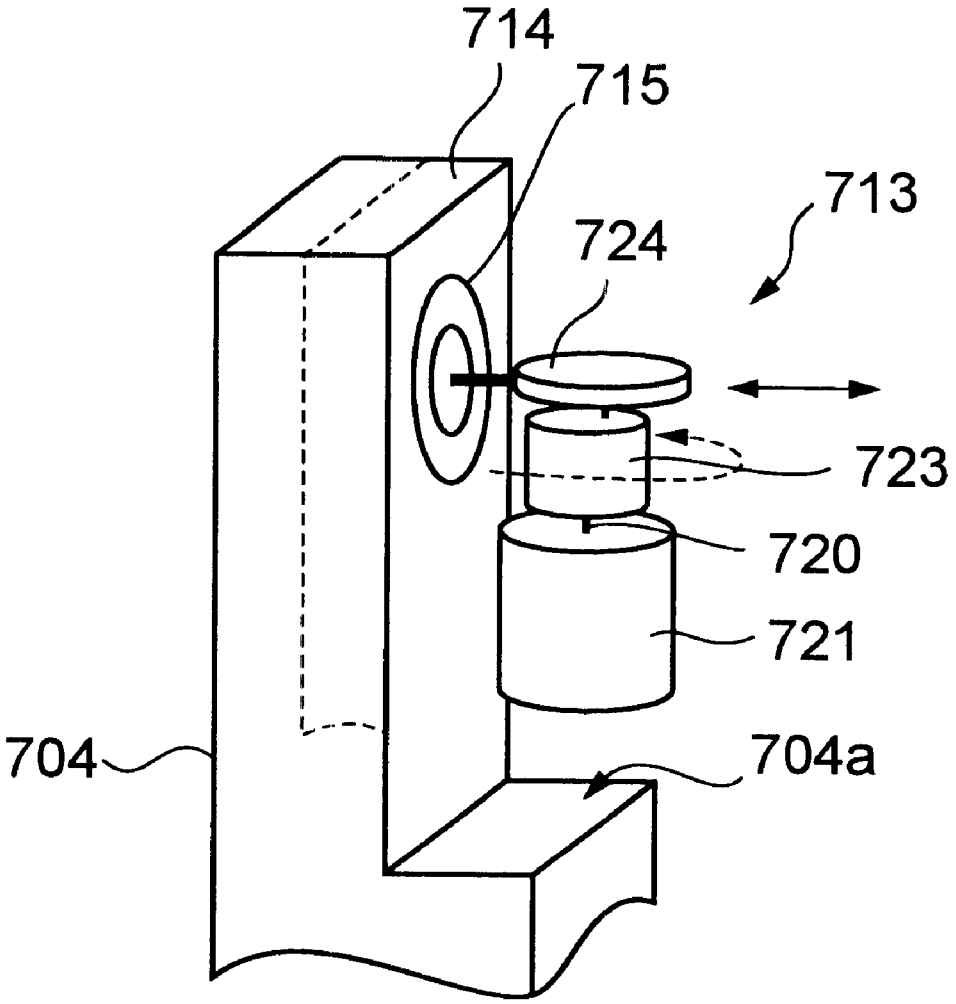
FIG. 15 is a partial perspective view showing the structure of the solution supplying device shown in FIG. 14.
Figure 16A:
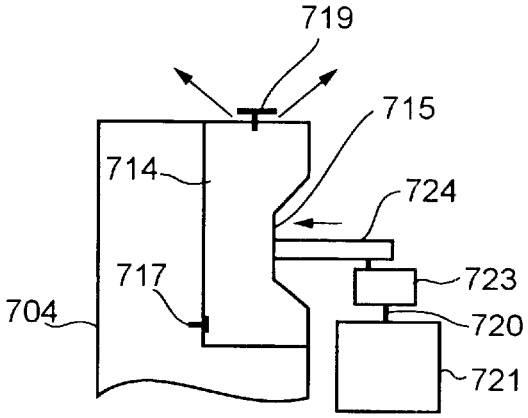
FIGS. 16A and 16B are schematic diagrams for explaining the operation of the solution supplying device shown in FIG. 14.
Figure 16B:
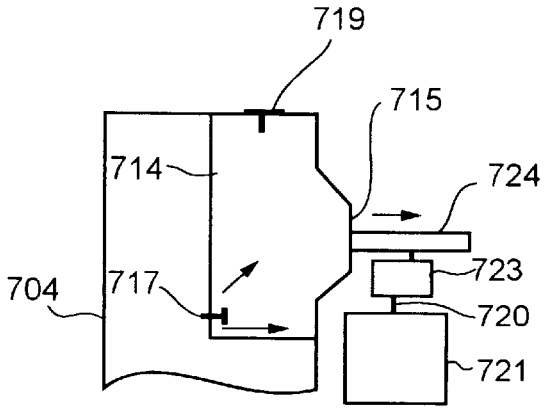

FIG. 15 is a perspective view showing the outlined structure of the air pump 713. FIGS. 16A and 16B are schematic diagrams for explaining the operation of the air pump 713.

The air pump 713 has an air chamber 714. The air chamber 714 is integrated with an upper portion of the stock tank 704. A resilient wall 715 is disposed in the air chamber 714 so that the resilient wall 715 faces the package 703. The resilient wall 715 is composed of for example a resilient member such as silicon rubber. The resilient wall 715 is formed in a circular shape. A separation wall 716 is disposed between the air chamber 714 and the stock tank 704. An air intake valve 717 is disposed on the separation wall 716. The air intake valve 717 draws air from the stock tank 704 to the air chamber 714. In addition, an air exhaust valve 719 is disposed on an upper wall 718 of the air chamber 714. The air exhaust valve 719 exhausts air from the air chamber 714 to the outside.

A motor 721 is disposed on the shoulder portion 704*a*. The motor 721 has a rotating shaft 720. The motor 721 is mounted on a side wall of the shoulder portion 704*a* through a mounting member 722. In addition, a disc shaped member 723 driven by the motor 721 is disposed on the rotating shaft 720. A connection member 724 that connects a predetermined position of the disc shaped member 723 and the resilient wall 715 is eccentrically driven by the disc shaped member 723. Such an eccentric drive can be accomplished by mounting the rotating shaft 720 of the motor 721 to a non-center position of the disc shaped member 723. Alternatively, such an eccentric drive can be accomplished by mounting the connection member 724 to a non-center position of the disc shaped member 723. Alternatively, such an eccentric drive can be accomplished by mounting the rotating shaft 720 of the motor 721 to a non-center position of the disc shaped member 723 and the connection member 724 to a non-center position of the disc shaped member 723. Such an eccentric drive causes the rotation of the rotating shaft 720 to be converted into a reciprocal motion of the connection member 724 against the resilient wall 715. As shown in FIG. 16A, when the resilient wall 715 is shrank, the volume of the air chamber 714 is decreased. As a result, air is exhausted from the air chamber 714. Thus, as shown in FIG. 16B, when the air chamber 714 is expanded, the volume of the air chamber 714 is increased. Consequently, air can be drawn to the resilient wall 715. In other words, the rotation drive of the motor 721 causes air to be forcedly drawn from the stock tank 704 through the air chamber 714.

A float sensor 725 is disposed in the stock tank 704. The float sensor 725 is an entrained gas sensor that operates when the amount of a gas that gathers at the upper portion of the stock tank 704 exceeds a predetermined value. In addition, the float sensor 725 functions as a sensor that detects the solution empty state of the package 703. According to the fourth embodiment, the sensor 725 is a float sensor. The float sensor 725 has a float 726 and a sensing portion 727. When the float sensor is submerged with a solution 728, the float 726 contacts the sensing portion 727 due to the buoyancy of the float 726. When a gas reaches the position of the float sensor, the float 726 separates from the sensing portion 727. Thus, a signal that is output from the float sensor 725 is sent to a controlling portion 729. The controlling portion 729 causes the air pump 713 to start and stop, the solution supplying pump 706 to start, and the LED 712 to light.

Figure 17:
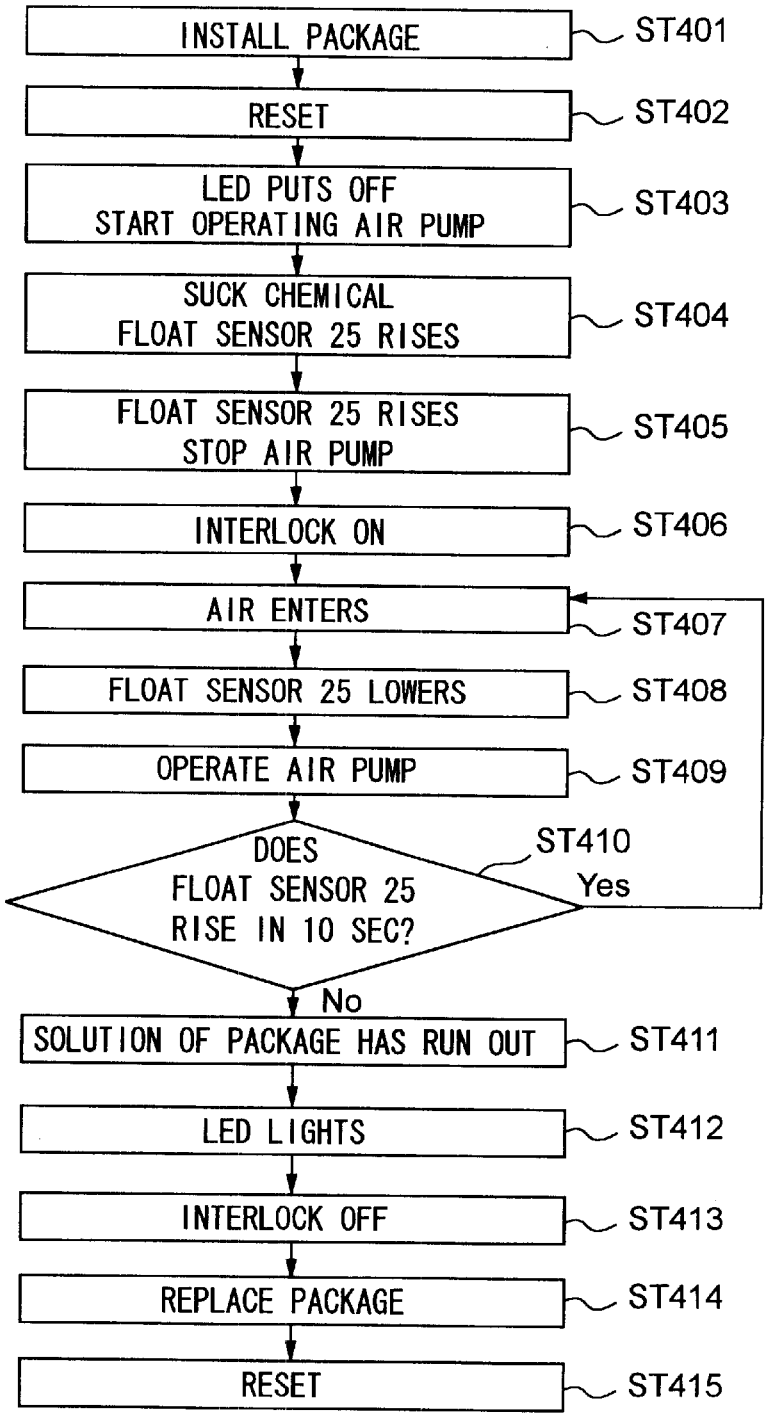
FIG. 17 is a flow chart for explaining the operation of the solution supplying device shown in FIG. 14.

Next, with reference to a flow chart shown in FIG. 17, the operation of the solution supplying device 701 according to the fourth embodiment will be described.

First of all, the case that after the undiluted process solution packed in the package 703 installed in the tray 710 has run out, the package 703 is quickly replaced with a new one will be described. A new (non-used) package 703 is installed in the solution supplying device 701 (at step ST401).

After the package 703 is attached, when the reset operation is performed (for example, a reset button (not shown) is pressed) (at step ST402), the LED 712 is put off. In addition, the air pump 713 is operated (at step ST403). The undiluted process solution packed in the package 703 is sucked to the stock tank 704 by the air pump 713. As a result, the float 726 of the float sensor 725 rises (at step ST404).

When the float 726 of the float sensor 725 rises to the position of the sensing portion 727, the air pump 713 is stopped (at step ST405). As a result, an interlock on state takes place (at step ST406). In the interlock on state, the arm 711 cannot be opened unless a predetermined operation is performed. Thus, the operation can be safely performed.

After the reset operation is completed, the solution supplying pump 706 is operated corresponding to a replenishment request for the processing tank 705. Thus, the undiluted process solution is sucked from the package 703. The sucked undiluted process solution is supplied to the processing tank 705 through the stock tank 704. Thus, as the amount of the undiluted process solution packed in the package 703 decreases, the package 703 shrinks.

When the package 703 contains air or a solution that has been packed in the package 703 for a long time produces a gas, as the solution is supplied, the air or gas is also sucked as an entrained gas. As a result, the entrained gas enters the flow path (at step ST407). The entrained gas quickly separates from the solution in the stock tank 704 and gathers at an upper portion of the stock tank 704. As a result, the solution level lowers from the position of the float sensor 725. The float sensor 725 detects the decrease of the solution level (at step ST408). Thus, a signal that is output from the float sensor 725 is sent to the controlling portion 728. The controlling portion 728 causes the air pump 713 to operate (at step ST409).

When the air pump 713 is operated, the gas is exhausted from the stock tank 704 to the outside. As a result, the solution level of the undiluted process solution 728 rises. As a result, the air pump 713 is stopped. Thereafter, the loop from step ST407 to ST409 is repeated.

When the undiluted process solution 702 is further supplied, the undiluted process solution 702 stocked in the package 703 runs out. In this case, even if the air pump 713 is operated, the solution level of the solution 728 stocked in the stock tank 704 does not rise. To solve such a problem, according to the fourth embodiment, when the float 726 of the float sensor 725 does not rise to the position of the sensing portion 727 even if 10 seconds elapse after the air pump 713 is operated (at step ST410), it is assumed that the undiluted process solution 702 of the package 703 has run out (at step ST411). At that point, the LED 712 lights so as to notify the operator that the undiluted process solution 702 of the package 703 has run out (at step ST412). In addition, the interlock on state is deactivated (at step ST413).

Thus, the package 703 is replaced with a new one (at step ST414). Thereafter, the reset operation is performed (at step ST415).

As described above, in the solution supplying device 701 according to the fourth embodiment, the air pump 713 with a small drive stroke is integrally disposed at an upper portion of the stock tank 703. Thus, the solution supplying device 701 can be compactly structured.

In addition, in the solution supplying device 701 according to the fourth embodiment, since the float sensor 725 has both the function for detecting the solution level for controlling the operation of the air pump and the function for detecting the time at which the package should be replaced, the number of float sensors can be minimized. As a result, the number of parts of the device can be reduced.

(Fifth Embodiment)

Next, a fifth embodiment of the present invention will be described.

Figure 18:
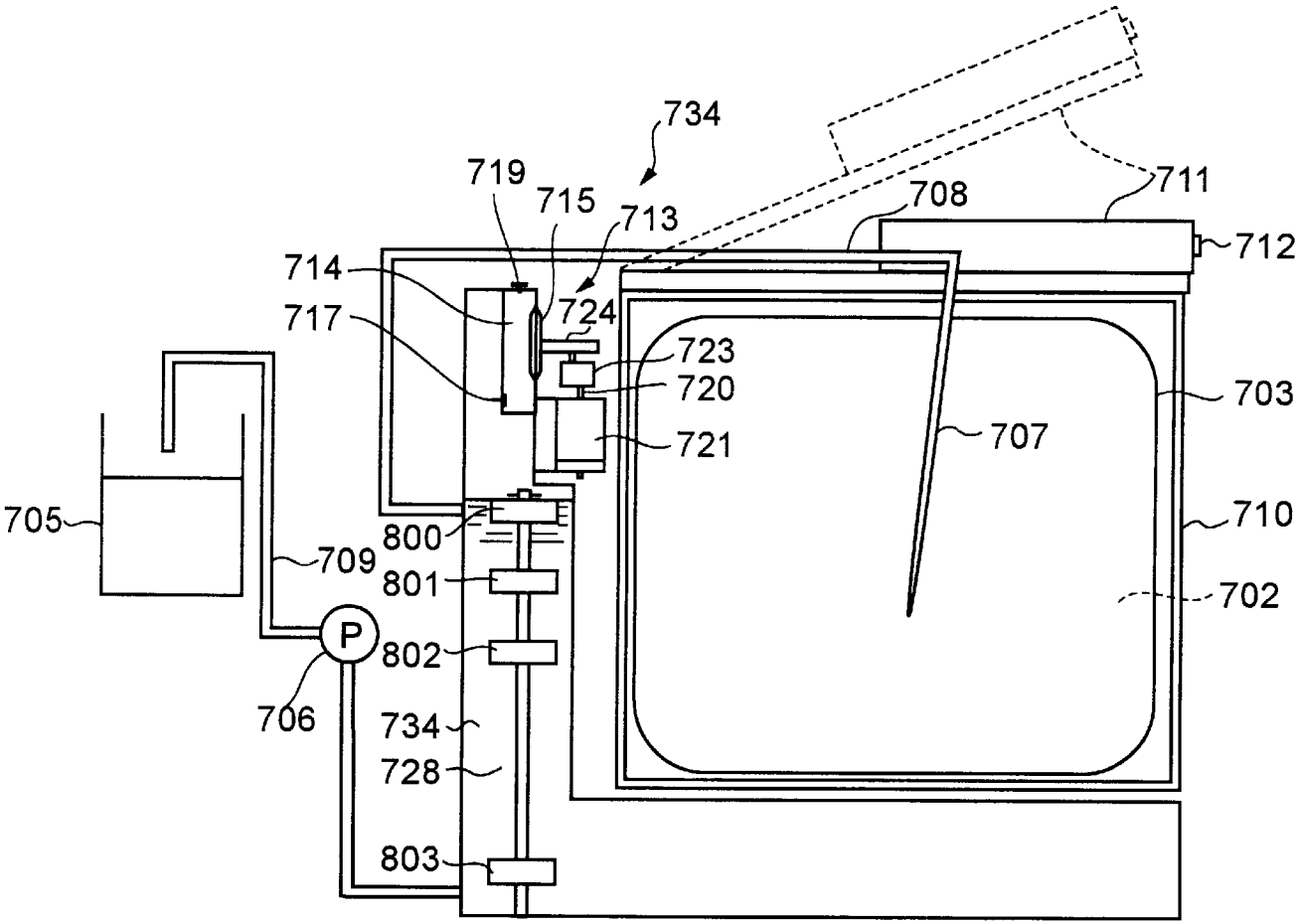
FIG. 18 is a schematic diagram showing the structure of a solution supplying device according to a fifth embodiment of the present invention.

FIG. 18 is a schematic diagram showing the structure of a solution supplying device 731 according to the fifth embodiment of the present invention. The fifth embodiment shown in FIG. 18 is different from the above-described embodiment in the structures of a stock tank and float sensors. For simplicity, in the fifth embodiment shown in FIG. 18, similar portions to those in the above-described embodiments are denoted by similar reference numerals.

According to the fifth embodiment, a stock tank 734 is formed in a rectangular parallelepiped shape. The bottom area of the stock tank 734 is in the range from 3 to 30 $cm^2$. The height of the stock tank 734 is in the range from 6 to 20 cm. The stock tank 734 has two rectangular parallelepipeds in a stair shape. According to the fifth embodiment, the stock tank 734 stocks a undiluted process solution as a spare. The capacity of the stock tank 734 is one to ten times larger than the capacity of a package 703. Thus, when the undiluted process solution packed in the package 703 has run out, even if the package 703 is replaced with a new one, the undiluted process solution stocked in the stock tank 734 can be used. Thus, the developing process can be always performed with predetermined quality, not stopped for replacing the package 703. Thus, the labor of the operator for the intervention of the automatic developing device can be reduced. The shape and the stock tank 734 can be varied corresponding to the structure such as the dead space of the automatic developing device. According to the fifth embodiment, both a spare tank that stocks an undiluted process solution as a spare and a stock tank are integrated. Alternatively, the stock tank may be separately disposed in such a manner that the spare tank is disposed between the stock tank and the solution supplying pump 706.

The stock tank 734 has four sensors 800 to 803. The sensor 800 is a sensor that operates when the amount of the undiluted process solution stocked in the stock tank 734 exceeds a predetermined value. The sensor 801 is an entrained gas sensor that operates when a gas that gathers at the upper portion of the stock tank 734 exceeds a predetermined value. The sensor 802 is a sensor that detects the solution empty state of the undiluted process solution stoked in the package 720. The sensor 803 is a sensor that detects the solution empty state of the undiluted process solution of the stock tank 734. The sensors 800 to 803 are sensors that detect solution levels of the undiluted process solution. According to the fifth embodiment, the sensors 800 to 803 are float sensors. The structures of the float sensors 800 to 803 are the same as those of the first embodiment.

Figure 19:
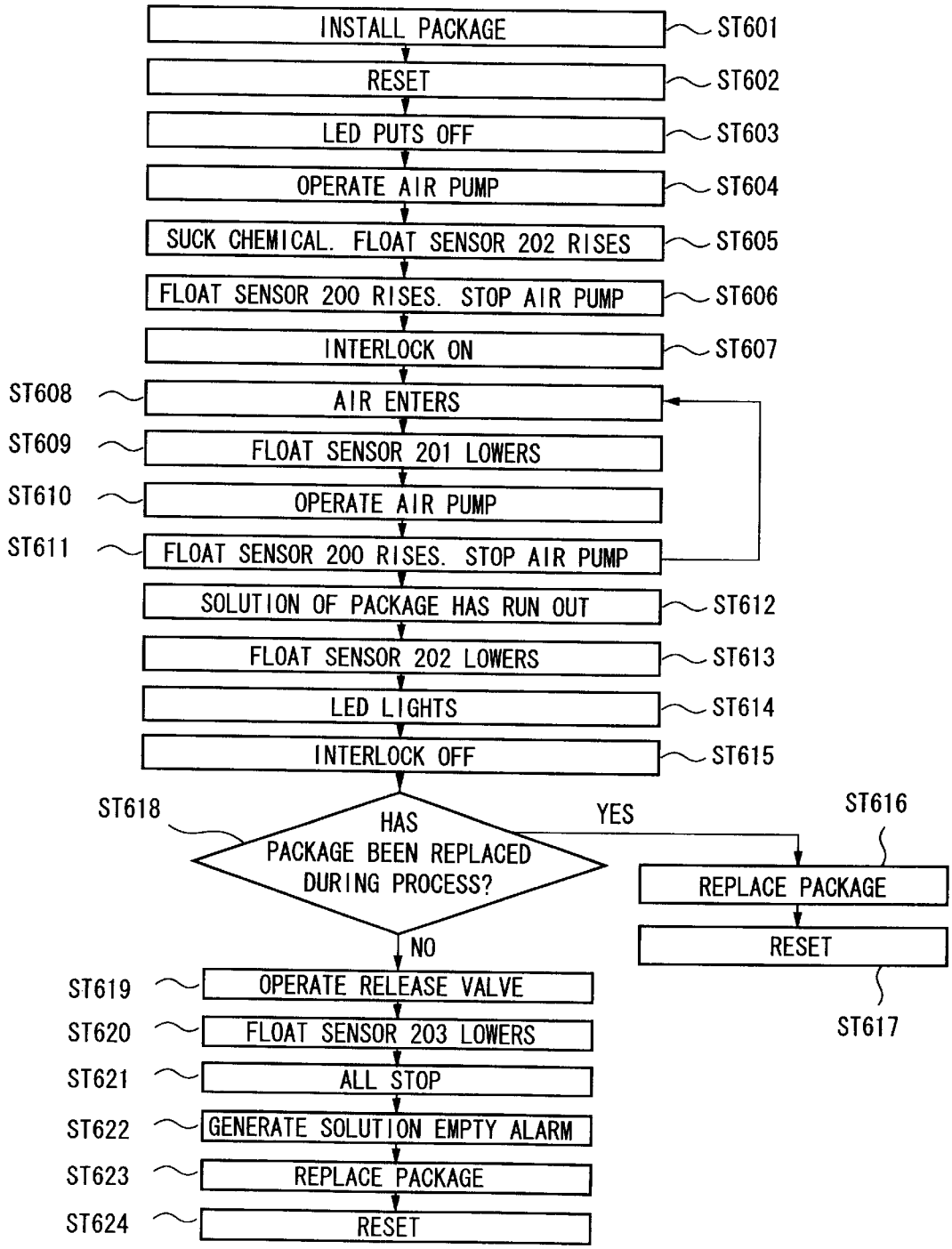
FIG. 19 is a flow chart for explaining the operation of the solution supplying device shown in FIG. 18.

Next, with reference to a flow chart shown in FIG. 19, the operation of the solution supplying device 731 will be described.

The case that after the undiluted process solution packed in the package 703 installed in the tray 710 has run out, the package 703 is quickly replaced with a new one will be described. In the case, a new package 703 is installed in the solution supplying device 701 (at step STT601).

After the new package 703 is attached, when the reset operation is performed (for example, a reset button (not shown) is pressed) (at step ST602), the LED 712 is put off (at step ST603). In addition, the air pump 713 is started (at step ST604). The air pump 713 sucks the undiluted process solution packed in the package 703 to the stock tank 734 and thereby the float of the float sensor 802 rises (at step ST605).

Thereafter, when the float of the float sensor 800 has risen to the position of the sensing portion, the air pump 713 is stopped (at step ST606). At that point, the interlock on state takes place (at step ST607).

After the reset operation has been completed, the solution supplying pump 706 is operated corresponding to a replenishment request for the processing tank 705. The solution supplying pump 706 sucks the undiluted process solution from the package 703. The undiluted process solution is supplied from the package 703 to the processing tank 705 through the stock tank 734. As the amount of the undiluted process solution packed in the package 703 decreases, the package 703 shrinks.

When the package 703 contains air or a solution that has been packed in the package 703 for a long time produces a gas, as the solution is supplied, the air or gas is also sucked as an entrained gas. As a result, the entrained gas enters the flow path (at step ST608). The entrained gas quickly separates from the solution in the stock tank 734 and gathers at an upper portion of the stock tank 734. Thus, the solution level lowers from the position of the float sensor 801. The float sensor 801 detects the decrease of the solution level (at step ST609). Thus, a signal that is output from the float sensor 801 is sent to the controlling portion. The controlling portion causes the air pump 713 to operate (at step ST610).

When the air pump 713 is operated, the gas is exhausted from the stock tank 734 to the outside. As a result, the solution level of the undiluted process solution 728 stocked in the stock tank 734 rises. The float sensor 800 detects the increase of the solution level. As a result, the air pump 713 is stopped (at step ST611). Thereafter, the loop from steps ST608 to ST611 is repeated.

When the undiluted process solution 702 is further supplied, the undiluted process solution 702 packed in the package 703 runs out. At that point, even if the air pump 713 is operated, the float sensor 800 cannot detect the solution level of the undiluted process solution stocked in the stock tank 734. Thus, it is assumed that the undiluted process solution 702 packed in the package 703 has run out (at step ST612).

Thereafter, when the solution level lowers from the solution sensing level of the float sensor 802 (at step ST613), the LED 712 lights, notifying that the operator that the undiluted process solution packed in the package 703 has run out (at step ST614). In addition, the interlock on state is deactivated (at step ST615).

Thus, the package 703 is replaced with a new one (at step ST616). Thereafter, the reset operation is preformed (at step ST617). When the package 703 is not replaced (at step ST618), a release valve (not shown) is operated (at step ST619). When the solution level lowers from the solution detecting level of the float sensor 803 (at step ST620), all the operations are stopped (at step ST621). In addition, a solution empty alarm is generated (at step ST622). Thus, the package 703 is replaced (at step ST623). Thereafter, the reset operation is performed (at step ST624).

(Sixth Embodiment)

Next, a sixth embodiment of the present invention will be described.

Figure 20:
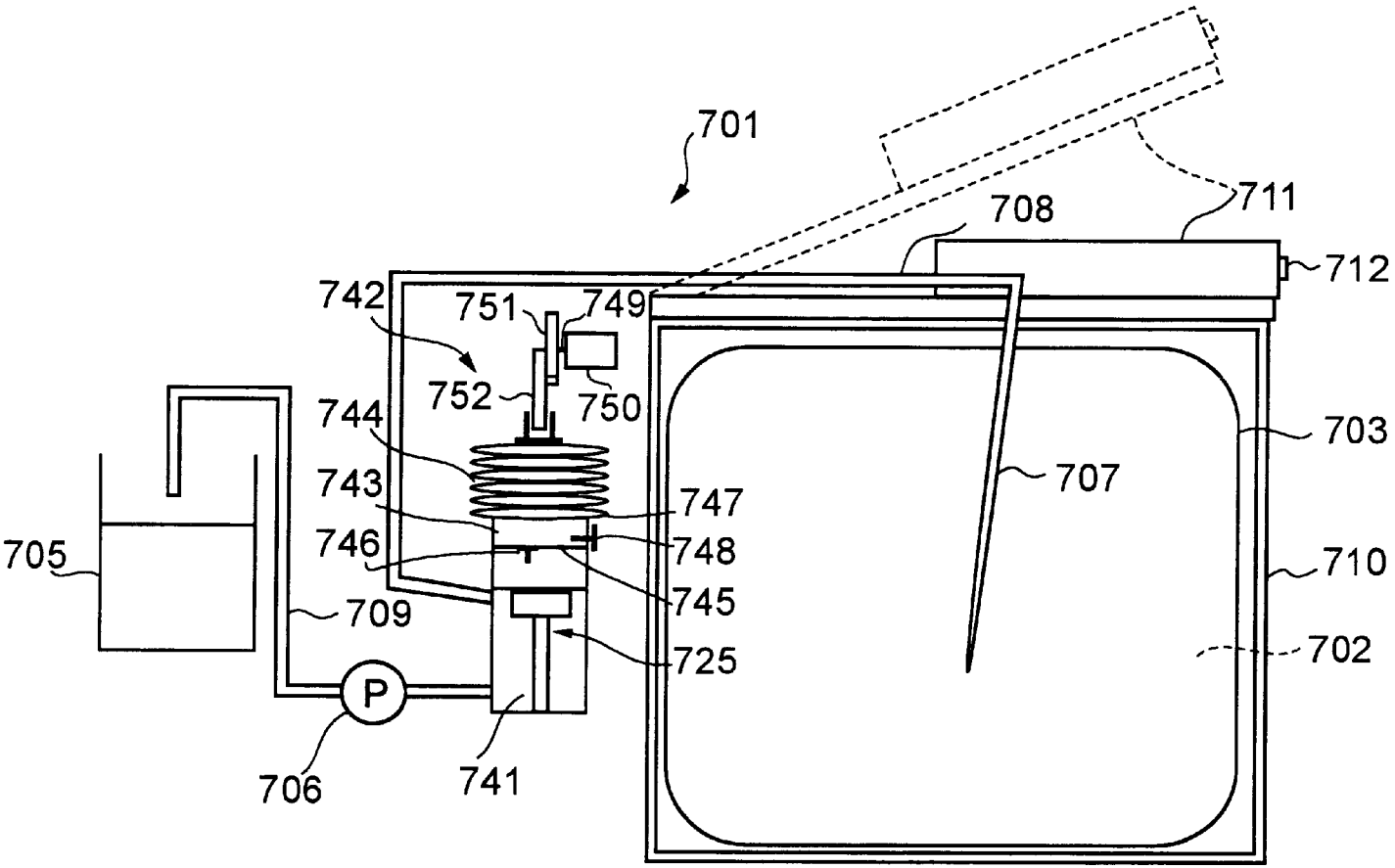
FIG. 20 is a schematic diagram showing the structure of a solution supplying device according to a sixth embodiment of the present invention.

FIG. 20 is a schematic diagram showing the structure of a solution supplying device 741 according to the sixth embodiment. The sixth embodiment shown in FIG. 20 is different from the fourth embodiment in the structures of stock tanks and air pumps. For simplicity, in FIG. 20, similar portions to those shown in FIG. 14 are denoted by similar reference numerals.

As shown in FIG. 20, an air pump 742 is integrally disposed on a stock tank 741 formed almost in a cylindrical shape or a rectangular parallelepiped shape.

The air pump 742 has a first air chamber 743 and a second air chamber 744. The first air chamber 743 is disposed at an upper portion of the stock tank 741. The second air chamber 744 is disposed on the first air chamber 743. The second air chamber 744 is formed in a bellows shape so that the second air chamber 744 can be expanded and shrunk in the vertical direction. A wall portion 745 is disposed between the first air chamber 743 and the stock tank 741. An air intake valve 746 is disposed on the wall portion 745. The air intake valve 746 draws air from the stock tank 741 to the first air chamber 743 and the second air chamber 744. An air exhaust valve 748 is disposed on a side wall 747 of the first air chamber 743. The air exhaust valve 748 exhausts air from the first air chamber 743 and the second air chamber 744 to the outside.

Figure 21:
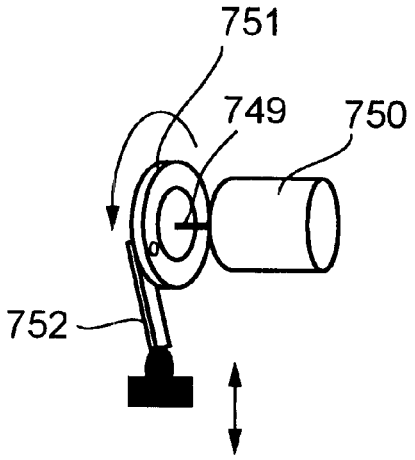
FIG. 21 is a partial perspective view showing the structure of the solution supplying device shown in FIG. 20.
Figure 22A:
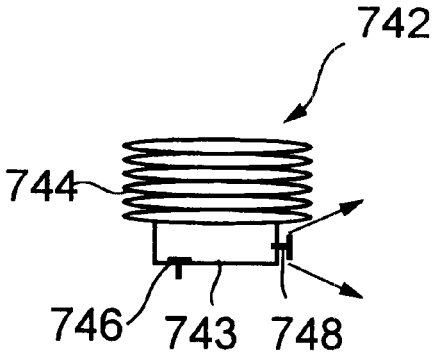
FIGS. 22A and 22B are schematic diagrams for explaining the operation of the solution supplying device shown in FIG. 20.
Figure 22B:
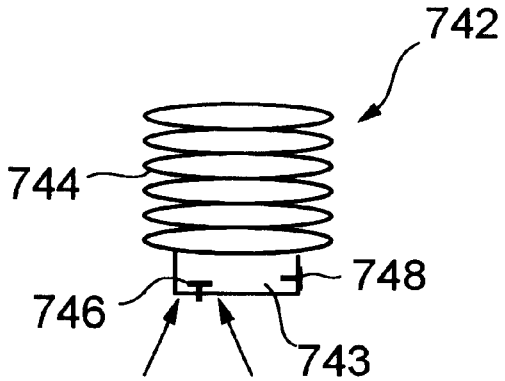

As shown in FIG. 21, a motor 750 is disposed at an upper portion of the second air chamber 744. The motor 750 has a rotating shaft 749. A disc shaped member 751 is disposed on the rotating shaft 749 of the motor 750. The disc shaped member 751 is eccentrically driven by the motor 750. A predetermined position of the disc shaped member 751 and the second air chamber 744 are connected by a connecting member 752. The eccentric drive is performed in the same manner as the first embodiment. The eccentric drive causes the rotation of the rotating shaft 749 to be converted into the expansion-shrink (lifting operation) of the second air chamber 744. As shown in FIG. 22A, when the second air chamber 744 is shrunk, the volume of the first air chamber 743 and the second air chamber 744 is decreased. As a result, air is exhausted from the first air chamber 743 and the second air chamber 744. As shown in FIG. 22B, when the second air chamber 744 is expanded, the volume of the first air chamber 743 and the second air chamber 744 is increased. Thus, air is drawn to the first air chamber 743 and the second air chamber 744. In other words, the rotation of the rotating shaft 749 causes air to be forcedly exhausted from the stock tank 741 through the first air chamber 743 and the second air chamber 744.

In the solution supplying device according to the sixth embodiment, since the air pump 742 having a small drive stroke is integrally disposed at an upper portion of the stock tank 741, the solution supplying device 701 can be compactly structured.

Figure 23:
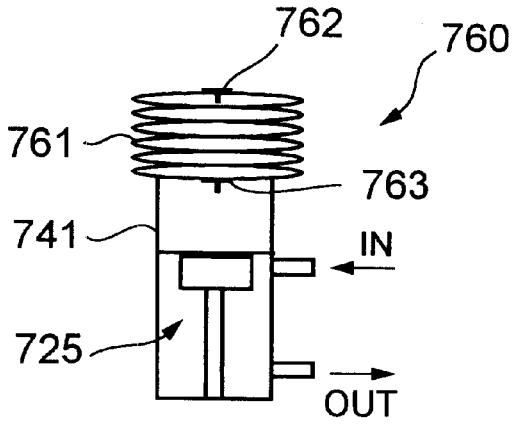
FIG. 23 is a schematic diagram showing the structure of the solution supplying device according to a modification of the sixth embodiment.
Figure 24:
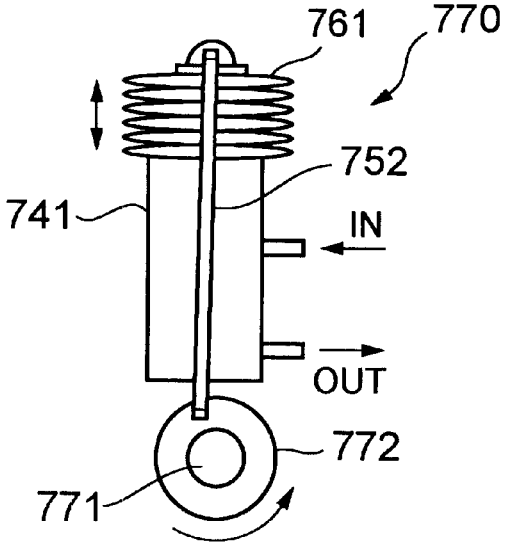
FIG. 24 is a schematic diagram showing the structure of the solution supplying device according to another modification of the sixth embodiment.

As shown in FIG. 23, an air pump 760 having a bellows type air chamber can expand and shrink an air chamber 761. An air exhaust valve 762 and an air intake valve 763 may be disposed at an upper portion and a lower portion an air pump 760. As shown in FIG. 24, a motor 771 and a disc shaped member 772 may be disposed below the stock tank 741.

Figure 25:
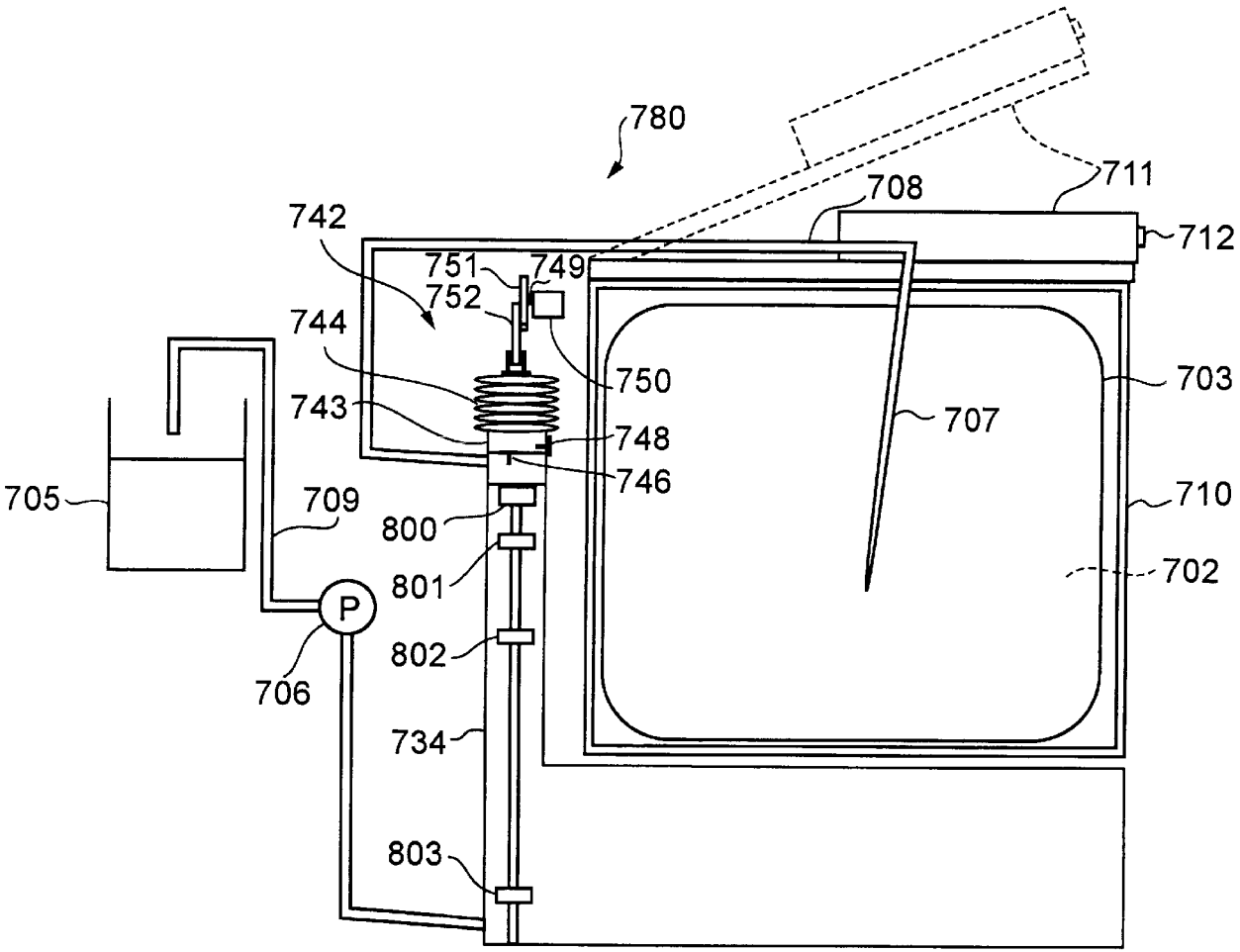
FIG. 25 is a schematic diagram showing the structure of a solution supplying device according to a seventh embodiment of the present invention.

In addition, as shown in FIG. 25, the air pump 742 according to the sixth embodiment may be used for the stock tank 734 according to the fifth embodiment. In such a structure, a solution supplying device 780 may be accomplished.

The solution supplying devices and the air pumps according to the present invention are not limited to the above-described embodiments. In other words, the solution supplying devices and the air pumps may be applied to those that supply solutions such as chemicals, paints, emersion, coating agent, and functional film forming agents that tend to be oxidized, alternated, and deteriorated with air, those that supply solutions that are harmful to human bodies, and solutions, and those that supply a predetermined amount of drinks and noodle soups.

An aspect of the present invention is a solution supplying device comprising a stock tank for stocking a solution supplied from a vessel that packs the solution, a solution supplying pump for supplying the solution stocked in the stock tank to a destination, an air chamber disposed at an upper portion of the stock tank, the volume of the air chamber being variable, and an air pump for drawing air from the stock tank to the air chamber through an air intake valve and exhausting air from the air chamber to the outside through an air exhaust valve. According to the aspect of the present invention, since the air pump having the air chamber whose volume is variable is used, the air pump itself is small. In addition, the air pump can be integrated with the stock tank. Thus, the solution supplying device can be compactly structured. In particular, since the solution supplying device uses the air pump that draws air from the stock tank to the air chamber through the air intake tank, the air pump is optimally disposed at an upper portion of the stock tank. In that case, the area for the air pump can be reduced in comparison with the case that the stock tank and the pump are separately disposed. Thus, the solution supplying device according to the present invention contributes to the compact structure of a device such as an automatic developing device that performs a solution process.

Preferably, the air pump comprises a resilient wall disposed on the air chamber and a driving portion for causing the resilient wall to resiliently expand and shrink. Since the air pump is accomplished in such a manner that the resilient wall is expanded and shrunk by the driving portion, the stroke of the driving portion can be shortened. Thus, the structure of the air pump contributes to the compact structure of a device such as an automatic developing device that performs a solution process. In particular, when the driving portion comprises a motor having a rotating shaft, a disc shaped member disposed on the rotating shaft so that the disc shaped member is eccentrically rotated, and a connecting member for connecting a predetermined position of the disc shaped member and the resilient wall, the stroke of the driving portion can be further shortened. Thus, the driving portion contributes to the compact structure of a device such as an automatic developing device that performs a solution process.

All or part of the air chamber may be resiliently structured in a bellows shape. A driving portion for expanding and shrinking the bellows shaped air chamber may be disposed in the air chamber. The air chamber contributes to the decrease of the stroke of the driving portion and thereby the compact structure of a device such as an automatic developing device that performs a solution process. In that case, likewise, the driving portion may comprise a motor having a rotating shaft, a disc shaped member disposed on the rotating shaft so that the disc shaped member is eccentrically rotated, and a connecting member for connecting a predetermined position of the disc shaped member and the bellows shaped air chamber.

The solution supplying device may further comprise a sensor for detecting a predetermined solution level of the solution stocked in stock tank and a controller for controlling the operation of the air pump corresponding to the detected result of the sensor. Thus, in the very simple structure, the solution empty state can be prevented from being incorrectly detected. In that case, preferably, after the air pump is operated corresponding to the detected result of the sensor, when a predetermined solution level cannot be detected in a predetermined time period by the sensor, the controller generates a predetermined alarm. Thus, in the simple structure, the solution empty state can be detected.

Another aspect of the present invention is a solution supplying device comprising a stock tank for stocking a solution supplied from a vessel that packs the solution, a solution supplying pump for supplying the solution stocked in the stock tank to a destination, an air chamber integrally disposed at an upper portion of the stock tank, a resilient wall being disposed on one side of the air chamber, an air intake valve for drawing air from the stock tank to the air chamber, an air exhaust valve for exhausting air from the air chamber to the outside, a motor having a rotating shaft, a disc shaped member disposed on the rotating shaft so that the disc shaped member is eccentrically rotated, and a connecting member for connecting a predetermined position of the disc shaped member and the resilient wall. In that case, it is preferred to dispose a shoulder portion at an upper portion of the stock tank, dispose the resilient wall to a side wall of the shoulder portion, and dispose the motor, the disc shaped member, and the connecting member on the shoulder portion. Thus, the solution supplying device can be structured without a space loss.

Another aspect of the present invention is a solution supplying device comprising a stock tank for stocking a solution supplied from a vessel that packs the solution, a solution supplying pump for supplying the solution from the stock tank to a destination, an air chamber integrally disposed at an upper portion of the stock tank and fully or partly resiliently structured in a bellows shape, an air intake valve for drawing air from the stock tank to the air chamber, an air exhaust valve for exhausting air from the air chamber to the outside, a motor having a rotating shaft, a disc shaped member disposed on the rotating shaft so that the disc shaped member is eccentrically rotated, and a connecting portion for connecting a predetermined position of the disc shaped member and the bellows shaped air chamber. In that case, when the motor and the disc shaped member are disposed at an upper position or a lower position of the stock tank, the solution supplying device can be structured without a space loss.

Another aspect of the present invention is an air pump comprising an air chamber having a resilient wall disposed on one side thereof, an air intake valve for drawing air from the outside to the air chamber, an air exhaust valve for exhausting air from the air chamber to the outside, a motor having a rotating shaft, a disc shaped member disposed on the rotating shaft so that the disc shaped member is eccentrically rotated, and a connecting member for connecting a predetermined position of the disc shaped member and the resilient wall. With the air pump, a solution supplying device can be compactly structured.

Another aspect of the present invention is an air pump comprising an air chamber that is resilient and formed fully or partly in a bellows shape, an air intake valve for drawing air from the outside to the air chamber, an air exhaust valve for exhausting air from the air chamber to the outside, a motor having a rotating shaft, a disc shaped member disposed on the rotating shaft so that the disc shaped member is eccentrically rotated, and a connecting member for connecting a predetermined position of the disc shaped member and the bellows shaped air chamber. With the air pump, the solution supplying device can be compactly structured.

As was described above, according to the present invention, since a stock tank that stocks a solution supplied from a vessel that packs the solution and an air pump having a small drive stroke are integrally disposed, in a solution supplying system of which an undiluted process solution can be stably supplied and a vessel can be easily replaced, even if a large amount of gas enters a flow path, the device can be prevented from malfunctioning. In addition, the device can be prevented from becoming large.

The disclosure of Japanese Patent Application No.2000-155286 filed May 25, 2000 and No.2000-302772 filed Oct. 2, 2000, including specification, drawings and claims are herein incorporated by reference in its entirety.

Although only some exemplary embodiments of this invention have been described in detail above, those skilled in the art will readily appreciated that many modifications are possible in the exemplary embodiments without materially departing from the novel teachings and advantages of this invention. Accordingly, all such modifications are intended to be included within the scope of this invention.

What is claimed is:

1. A device for temporarily stocking a solution supplied from a vessel that packs the solution and supplying the solution to a destination, comprising:

a stock tank for stocking the solution supplied from the vessel;

a solution supplying pump connected to said stock tank for pumping the solution from said stock tank to the destination; and a pressure varying portion located on said stock tank for relieving a reduced pressure state in said stock tank.

2. The device as set forth in claim 1, wherein said pressure varying portion has:

a valve disposed on said stock tank and opened so that outside air enters said stock tank when the inner pressure of said stock tank is a predetermined value or less.

3. The device as set forth in claim 1, wherein said pressure varying portion has:

a volume varying chamber, disposed at a part of said stock tank, for varying the inner volume so as to vary the inner pressure.

4. The device as set forth in claim 3, wherein the inner volume of said volume varying chamber is decreased when the inner pressure of said stock tank is a predetermined value or less.

5. The device as set forth in claim 1, wherein said pressure varying portion has:

an orifice, disposed on said stock tank, for allowing outside air to enter said stock tank when the inner pressure of said stock tank is a predetermined value or less.

6. The device as set forth in claim 1, further comprising:

a gas exhausting mechanism for exhausting a gas from a flow path for the solution, the flow path being formed from the vessel to said solution supplying pump.

7. The device as set forth in claim 6, wherein said gas exhausting mechanism has:

an exhausting pipe connected to said stock tank;

an air pump, connected to said exhausting pipe, for exhausting a gas from said stock tank through said exhausting pipe; and a flow rate adjusting mechanism for adjusting the flow rate of the gas exhausted by said air pump.

8. The device as set forth in claim 7, wherein said flow rate adjusting mechanism is composed of a plurality of pipes that have different diameters and that are connected.

9. The device as set forth in claim 7, further comprising:

a detecting portion for detecting a predetermined solution level of the solution, wherein the operation of said air pump is controlled by a detected result from said detecting portion.

10. The device as set forth in claim 9, wherein said detecting portion has:

a first sensor, disposed in said stock tank, for detecting a predetermined solution level of the solution; and a second sensor, disposed at a higher position than said first sensor in said stock tank, for detecting a predetermined solution level of said solution, and wherein said air pump is initiated in response to a detected result from said first sensor and is stopped in response to a detected result of said second sensor.

11. The device as set forth in claim 1, further comprising:

a third sensor, disposed in said stock tank, for detecting that the solution packed in the vessel runs out.

12. The device as set forth in claim 1, further comprising:

a fourth sensor for detecting that the solution stocked in said stock tank runs out.

* * * * *